US007522127B2

(12) United States Patent
Nakamoto et al.

(10) Patent No.: US 7,522,127 B2
(45) Date of Patent: Apr. 21, 2009

(54) DRIVING METHOD FOR DRIVING A DISPLAY DEVICE INCLUDING DISPLAY PIXELS, EACH OF WHICH INCLUDES A SWITCHING ELEMENT AND A PIXEL ELECTRODE, DISPLAY DEVICE, AND MEDIUM

(75) Inventors: Tatsuya Nakamoto, Mie (JP); Makoto Shiomi, Tenri (JP); Mitsuhiro Shigeta, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 722 days.

(21) Appl. No.: 11/012,119

(22) Filed: Dec. 16, 2004

(65) Prior Publication Data

US 2005/0168424 A1 Aug. 4, 2005

(30) Foreign Application Priority Data

Dec. 17, 2003 (JP) ..... 2003-419535
Dec. 13, 2004 (JP) ..... 2004-360440

(51) Int. Cl.
*G09G 3/20* (2006.01)

(52) U.S. Cl. ..... 345/58

(58) Field of Classification Search ..... 345/58, 345/90–101, 694
See application file for complete search history.

(56) References Cited

U.S. PATENT DOCUMENTS 4,600,274 A * 7/1986 Morozumi ..... 349/109
4,800,375 A * 1/1989 Silverstein et al. ..... 345/694
4,825,203 A 4/1989 Takeda et al.
5,253,091 A 10/1993 Kimura et al.
5,471,228 A 11/1995 Ilcisin et al.
5,619,225 A 4/1997 Hashimoto
5,798,740 A * 8/1998 Bitzakidis et al. ..... 345/92
5,841,411 A * 11/1998 Francis ..... 345/92
5,940,057 A 8/1999 Lien et al.
6,011,532 A * 1/2000 Yanai et al. ..... 345/92
6,014,193 A * 1/2000 Taira et al. ..... 349/73
6,023,315 A * 2/2000 Harrold et al. ..... 349/108
6,040,814 A 3/2000 Murakami et al.
6,177,914 B1 * 1/2001 Iwama et al. ..... 345/60

(Continued)

FOREIGN PATENT DOCUMENTS

EP 1 096 536 5/2001

(Continued)

*Primary Examiner*—Sumati Lefkowitz
*Assistant Examiner*—Robert E Carter, III
(74) *Attorney, Agent, or Firm*—Harness, Dickey & Pierce, PLC

(57) ABSTRACT

Out of two display pixels connected to the same gate line G2, a display pixel (A) is connected to a source line S2, and a display pixel (B) is connected to a source line S3, which is adjacent to the source line S2 and forms a parasitic capacitance with a pixel electrode of the display pixel (A). A write signal for a display pixel (A) is obtained by correcting an input signal for the display pixel (A) in accordance with an input signal for a display pixel (B) or a write signal for the display pixel (B). With this arrangement, it is possible to reduce crosstalk between the two display pixels in a display device, such as a liquid crystal display device, that drives display pixels through a plurality of source lines and a plurality of gate lines.

43 Claims, 17 Drawing Sheets

U.S. PATENT DOCUMENTS

| | | | | |
|---|---|---|---|---|
| 6,211,851 | B1 | 4/2001 | Lien et al. | |
| 6,888,604 | B2 * | 5/2005 | Rho et al. | 349/146 |
| 6,954,191 | B1 * | 10/2005 | Hirano et al. | 345/77 |
| 7,271,863 | B2 * | 9/2007 | Paukshto et al. | 349/96 |
| 2001/0043180 | A1 | 11/2001 | Mori et al. | |
| 2002/0140664 | A1 | 10/2002 | Enomoto et al. | |
| 2003/0035107 | A1 * | 2/2003 | Overbeck et al. | 356/405 |
| 2003/0043165 | A1 | 3/2003 | Miyachi et al. | |
| 2003/0117489 | A1 | 6/2003 | Jones et al. | |
| 2004/0263456 | A1 | 12/2004 | Miyachi et al. | |

FOREIGN PATENT DOCUMENTS

| | | | |
|---|---|---|---|
| GB | 2 303 437 | | 2/1997 |
| JP | 61-23199 | A | 1/1986 |
| JP | 04-67091 | A | 3/1992 |
| JP | 05-203994 | A | 8/1993 |
| JP | 06-259043 | A | 9/1994 |
| JP | 06-324649 | A | 11/1994 |
| JP | 7-005852 | A | 1/1995 |
| JP | 8-030241 | A | 2/1996 |
| JP | 09-81089 | A | 3/1997 |
| JP | 10-010517 | A | 1/1998 |
| JP | 11-272244 | A | 10/1999 |
| JP | 2000-330523 | A | 11/2000 |
| JP | 2001-042833 | A | 2/2001 |
| JP | 2001-108964 | A | 4/2001 |
| JP | 2001-184012 | A | 7/2001 |
| JP | 2001-290122 | A | 10/2001 |
| JP | 2001-343636 | A | 12/2001 |
| JP | 2002-116735 | A | 4/2002 |
| JP | 2002-169520 | A | 6/2002 |
| JP | 2002-258813 | A | 9/2002 |
| JP | 2003-52050 | A | 2/2003 |
| TW | 459262 | | 10/2001 |
| TW | 512382 | | 12/2002 |
| TW | 530292 | | 5/2003 |
| WO | WO 01/24154 | A1 | 4/2001 |
| WO | WO 02/21493 | | 3/2002 |

* cited by examiner

DRIVING METHOD FOR DRIVING A DISPLAY DEVICE INCLUDING DISPLAY PIXELS, EACH OF WHICH INCLUDES A SWITCHING ELEMENT AND A PIXEL ELECTRODE, DISPLAY DEVICE, AND MEDIUM

This nonprovisional application claims priority under 35 U.S.C. § 119(a) on Patent Application No. 2003/419535 filed in Japan on Dec. 17, 2003, and on Patent Application No. 2004/360440 filed in Japan on Dec. 13, 2004. The entire contents of these applications are hereby incorporated by reference.

FIELD OF THE INVENTION

The present invention relates to a display device driving method, a display device, and a program, which are for reducing color crosstalk and thereby improving color reproducibility.

BACKGROUND OF THE INVENTION

Conventionally, many drawbacks of display devices in terms of color reproducibility have been pointed out. In particular, it has been pointed out that liquid crystal display devices have the following two drawbacks.

Many liquid crystal display devices allow light transmittance by using the birefringent characteristic of liquid crystal. However, liquid crystal of different pixels (pixels for R, G, and B) show different transmittance with respect to the same voltage. Therefore, even if the same color (e.g. white (R=G=B)) is displayed, the hue could be different, depending on gradation.

An effective measure to solve this problem is setting an independent γ curve with respect to each of R, G, and B, either in an analog or digital way. For example, Patent Publication 1 (Japanese Publication for Laid-Open Patent Application, Tokukai 2002-258813 (publication date: Sep. 11, 2002)) discloses such a technique for independently correcting each of R, G, and B.

In shutter-type liquid crystal display devices, light of each color leaks regardless of display gradation. Especially, if the display gradation decreases, color purity (color saturation) decreases due to the light leakage. Moreover, since luminance efficiency is regarded as an important factor for many liquid crystal display devices, spectrum characteristics of backlight and color filters must be broad even if contrast is sufficient. Under such circumstance, the color saturation decreases as the luminance decreases.

An effective technique for improving the color purity is emphasizing the color saturation by increasing color saturation of such color that has relatively high color saturation, and decreasing color saturation of such color that has relatively low color saturation. For example, Patent Publication 2 (Japanese Publication for Laid-Open Patent Application, Tokukai 2003-52050 (publication date: Feb. 21, 2003)) discloses such a technique for correcting the color saturation.

In addition, the problem of crosstalk, which is caused by the coupling of adjacent pixels through parasitic capacitance, has been pointed out as a problem unique to TFT-LCDs. If there is an insulating film between a transparent electrode and a source line, parasitic capacitance is formed there. Likewise, parasitic capacitance is formed between a gate line and the transparent electrode, and between a source line and a common electrode. Due to the influence of the parasitic capacitances and the capacitance of the liquid crystal itself, the potential of the display pixels could be different from desired voltages, when the gate is OFF. As a result, the display gradation could be different from a desired gradation. For example, Patent Publication 3 (Japanese Publication for Laid-Open Patent Application, Tokukaihei 5-203994 (publication date: Aug. 13, 1993)) discloses a technique for reducing the parasitic capacitances as a means of solving the problem of crosstalk. However, this technique is still insufficient to reduce the crosstalk.

Incidentally, although these prior arts are effective in order to adjust the color reproducibility of a panel as a whole or of each display pixel, these prior arts cannot respond to a situation where reproduced colors change in accordance with display patterns generated by a display device.

To a display pixel connected to a TFT, a desired voltage is applied at the moment the gate is high. On the other hand, when the gate is low, the display pixel is connected to many peripheral electric circuits through parasitic capacitances. Since many of these peripheral electric circuits are related to panel design, the driving voltage can be set in advance while considering the parasitic capacitance formed between the display pixel and the peripheral electric circuits. Thus, the crosstalk caused by the parasitic capacitances formed between the display pixel and the peripheral electric circuits can be compensated in advance. However, since the potentials of source lines for driving other display pixels cannot be determined in advance, the crosstalk caused due to the other source lines cannot be compensated in advance.

A liquid crystal display device shown in FIG. 15(*a*) is provided with source lines Si (i: integer) and gate lines Gj (j: integer) arranged to be orthogonal. At each intersection of a source line and a gate line, a display pixel 100 and a switching element 200 are provided. Among display pixels 100, each display pixel (A) is provided with parasitic capacitances Csda, Csdb, Cgd, and Ccs. A display pixel (B) is a display pixel adjacent to a display pixel (A) in the direction along which the gate lines are provided.

Details of the parasitic capacitances are as follows:

Parasitic capacitance Csda: parasitic capacitance formed between a display pixel (A) and the source line S2, which drives the display pixels (A);

Parasitic capacitance Csdb: parasitic capacitance formed between a display pixel (A) and the source line S3, which drives the display pixels (B);

Parasitic capacitance Cgd: parasitic capacitance formed between a display pixel (A) and the gate line G2, which drives the display pixel (A); and Parasitic capacitance Ccs: parasitic capacitance formed between a common electrode line and a display pixel (A).

The capacitance of a display pixel (A) itself is Cp. The voltages applied to the gate lines change as shown in FIG. 15(*b*). While a display pixel (A) displays G, a display pixel (B) displays R or B. If the display gradation of the display pixel (A) is LA, and the display gradation of the display pixel (B) is LB, LA≠LB.

In this case, at the time the gate is high, if a drain voltage +V(A) is applied to the liquid crystal part of the display pixel (A), a drain voltage −V(B) is applied to the liquid crystal part of the display pixel (B). When the next gate line turns ON, −V(A) is applied to the source line for driving the display pixel (A), and +V(B) is applied to the source line for driving the display pixel (B).

In reality, however, a drain voltage is not applied directly to the display pixel (A). Instead, a drain voltage changed by the influence of the parasitic capacitances is applied to the display pixel (A). Specifically, an effective value Va of a voltage applied to the display pixel (A) is represented by $$Va=V(A)+(Csda\times V(A)+Cgd\times Vg+Csdb\times V(B)+Ccs\times Vc)/Cp$$

where Vg is a voltage applied to the gate line, and Vc is a voltage applied to an opposed electrode.

Thus, the voltage applied to the display pixel (A) is different from the desired drain voltage (A).

The parasitic capacitances Csda, Cgd, and Ccs, which are formed in the vicinity of the display pixel (A), can be estimated at the design stage. Therefore, the drain voltage can be set appropriately by considering values of the parasitic capacitances. This means that the parasitic capacitances do not have much influence on the display gradation of the display pixel (A).

However, the foregoing formula for calculating the effective voltage Va includes the parasitic capacitance Csdb and the drain voltage V(B). This means that the voltage Va is influenced by the source line connected to the display pixel (B). Therefore, depending on the display gradation of the display pixel (B), color crosstalk is caused (that is, the gradation of the display pixel (A) changes).

For example, when V(A)=±2.59V and V(B)=±1.21V, the voltage supplied to the display pixel (A) is ±2.45V. Thus, it is found that color balance changes.

Even if the parasitic capacitances are reduced at the design stage as disclosed in Patent Publication 3, the amount of crosstalk is only reduced. The color crosstalk cannot be eliminated completely. Therefore, the potential actually applied to the display pixel changes in accordance with the display pattern of the display device as a whole. As a result, the display pixel cannot reproduce desired luminance.

In theory, it is possible to compensate the crosstalk by providing new members, such as shield electrodes or wires. However, if new members are provided to the display device, production cost of the display device increases.

SUMMARY OF THE INVENTION

The present invention was made in view of the conventional problems described above. An object of the present invention is therefore to provide a display device driving method, a display device, and a program, which are for reducing the crosstalk efficiently.

To solve the foregoing problems, a method of the present invention for driving a display device is a method of driving a display device including display pixels each of which includes a switching element and a pixel electrode, each of the display pixels being provided at each intersection of a plurality of gate lines and a plurality of source lines, wherein: a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal for the first display pixel is obtained by correcting an input signal for the first display pixel in accordance with an input signal for the second display pixel or a write signal for the second display pixel. When a display pixel is connected to a source line, it means that the pixel electrode of the display pixel is connected to the source line through the switching element.

To solve the foregoing problems, a display device of the present invention is a display device comprising display pixels each of which includes a switching element and a pixel electrode, each of the display pixels being provided at each intersection of a plurality of gate lines and a plurality of source lines, wherein: a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal for the first display pixel is obtained by correcting an input signal for the first display pixel in accordance with an input signal for the second display pixel or a write signal for the second display pixel.

In a display device including display pixels each of which includes a switching element and a pixel electrode, each of the display pixels being provided at each intersection of a plurality of gate lines and a plurality of source lines, a part of the pixel electrode of a display pixel (first display pixel) overlaps with a source line that is adjacent to a source line connected to the display pixel (first display pixel), in other words, the part of the pixel electrode of the display pixel (first display pixel) overlaps with a source line that is connected to a second display pixel and that drives the second display pixel, while an insulating film or the like is provided in between. Where the pixel electrode of the first display pixel and the source line connected to the second display pixel overlap, a parasitic capacitance is formed. The parasitic capacitance influences the potential of the pixel electrode of the first display pixel.

Therefore, according to the foregoing arrangement, the input signal for the first display pixel is corrected in accordance with the input signal for the second display pixel or the write signal for the second display pixel, and the corrected signal is used as a write signal for the first display pixel. That is, in determining the write signal for the first display pixel, the influence of the parasitic capacitance between the pixel electrode of the first display pixel and the source line that drives the second display pixel is considered. In this respect, in the present invention, a signal obtained by correcting an input signal for the first display pixel in accordance with an input signal for the second display pixel (or a write signal for the second display pixel) and a capacitance value of the parasitic capacitance. An input signal is raw gradation data or raw voltage data for a pixel. A write signal is a voltage to be actually applied to a source line or a gradation corresponding to the voltage to be applied. The write signal for the second display pixel is a signal (voltage or gradation) obtained by correcting the input signal (voltage data or gradation data) for the second display pixel.

With this arrangement, it is possible to drastically reduce a gap between a display gradation and a desired gradation (amount of crosstalk) caused by the parasitic capacitance, which fluctuates the potential of the pixel electrode (each pixel electrode) of the first display pixel. As a result, it is possible to improve display quality (correct color balance).

A display device of the present invention is a display device including display pixels each of which includes a switching element and a pixel electrode, each of the display pixels being provided at each intersection of a plurality of gate lines and a plurality of source lines, wherein: a first display pixel is connected to a first gate line and a first source line, and a second display pixel is connected to a second source line, which is adjacent to the first display pixel, the display device further including a correcting circuit for correcting an input signal for the first display pixel in accordance with an input signal for the second display pixel or a write signal for the second display pixel and a capacitance value of a parasitic capacitance formed between the second source line and the first display pixel and outputting a write signal for the first display pixel. The parasitic capacitance formed between the second source line and the first display pixel includes, for example, a parasitic capacitance between the second source line and the pixel electrode of the first display pixel and a parasitic capacitance formed between the second source line and each electrode (drain electrode and the like) of the switching element.

A display device of the present invention is a display device including display pixels each of which includes a switching element and a pixel electrode, each of the display pixels being provided at each intersection of a plurality of gate lines and a plurality of source lines, wherein: a first display pixel and a second display pixel are connected to the same gate line, and the second display pixel is connected to a source line that is adjacent to a source line connected to the first display pixel and that forms a parasitic capacitance with the pixel electrode of the first display pixel, the display device further including a correcting circuit for correcting an input signal for the first display pixel in accordance with an input signal for the second display pixel or a write signal for the second display pixel and a capacitance value of the parasitic capacitance and outputting a write signal for the first display pixel. The parasitic capacitance includes, for example, a parasitic capacitance between a source line and the pixel electrode of the first display pixel and a parasitic capacitance formed between a source line and each electrode (e.g. drain electrode) of the switching element of the first display pixel. The input signal can be conceived as input signal data, and the write signal can be conceived as write signal data. A reference potential of each voltage is a ground potential.

For a fuller understanding of the nature and advantages of the invention, reference should be made to the ensuing detailed description taken in conjunction with the accompanying drawings.

DESCRIPTION OF THE EMBODIMENTS

With reference to the drawings, the following describes one embodiment of the present invention.

1. ARRANGEMENT OF THE DISPLAY DEVICE

Figure 2:
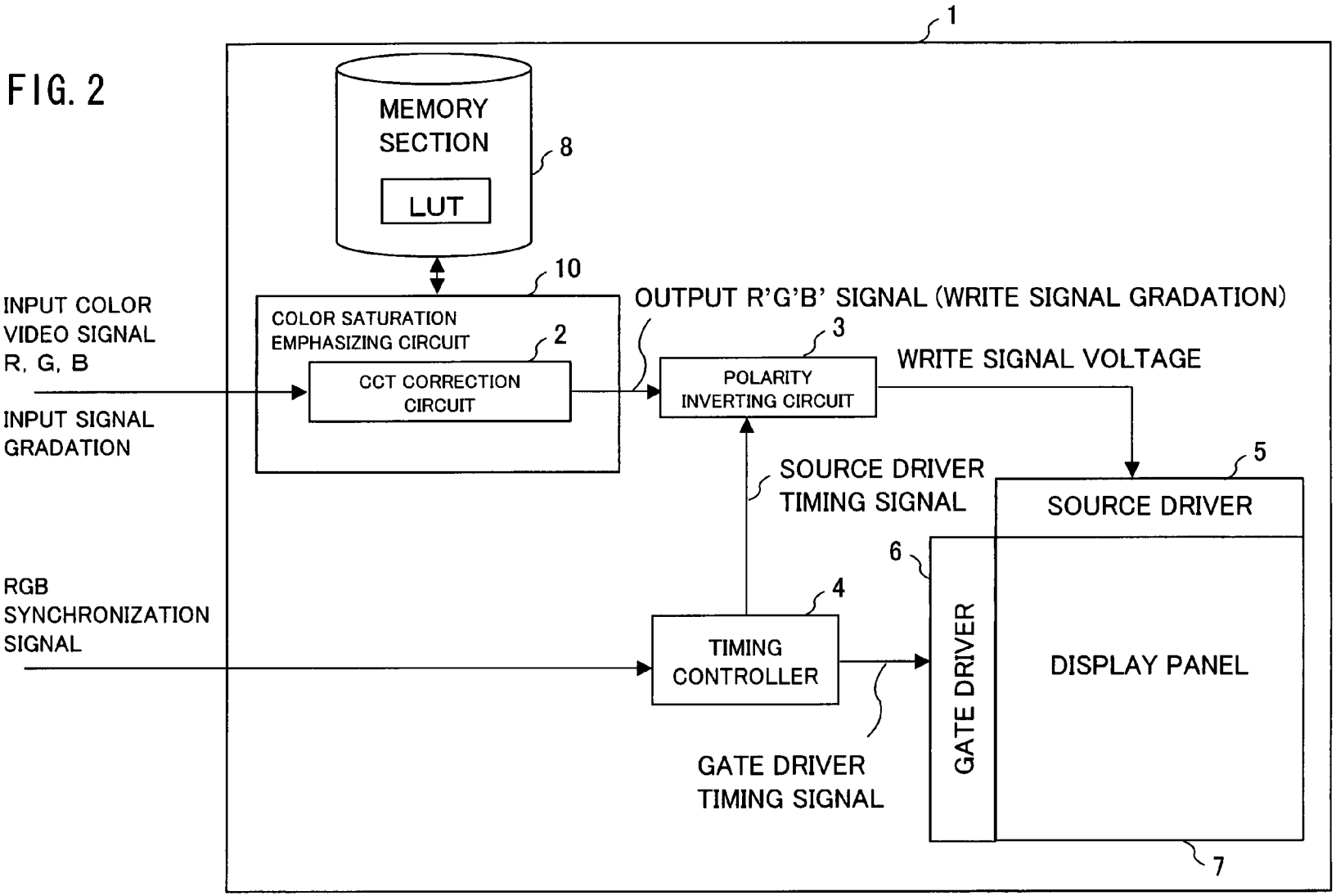
FIG. 2 is a block diagram illustrating an arrangement of a color display device in accordance with one embodiment of the present invention.

FIG. 2 illustrates one embodiment of a color display device (display device) 1 of the present invention. As shown in FIG. 2, the color display device 1 includes a CCT (color crosstalk) correction circuit 2, a polarity inverting circuit 3, a timing controller 4, a source driver 5, a gate driver 6, a display panel 7, and a memory section 8. In FIG. 2, members not related to the present invention are omitted drastically.

The CCT correction circuit 2 is a characteristic member of the present invention. The CCT correction circuit 2 corrects input signal gradations (input color signals) including a red signal R, a green signal G, and a blue signal B, which are inputted from outside, and outputs write signal gradations (output color video signals) R', G', and B', which are signals to be supplied to display picture elements (pixel groups; not shown) of the display panel 7. The red signal R represents a gradation level of R (first display color); the green signal G represents a gradation level of G (second display color); and the blue signal B represents a gradation level of B (third display color). The first, second, and third display colors may be cyan, magenta, and yellow, respectively. The CCT correction circuit 2 may be included in a color saturation emphasizing circuit 10.

The CCT correction circuit 2 latches the input color video signals R, G, and B, and delays them dot by dot, thereby performing a process (described later) for two display pixels connected to the same gate line.

The polarity inverting circuit 3 determines write voltage signals (analog data) to be supplied to the display pixels of the display panel 7, in accordance with the write signal gradations R', G', and B' (digital data), which are outputted from the CCT correction circuit 2.

Figure 14:
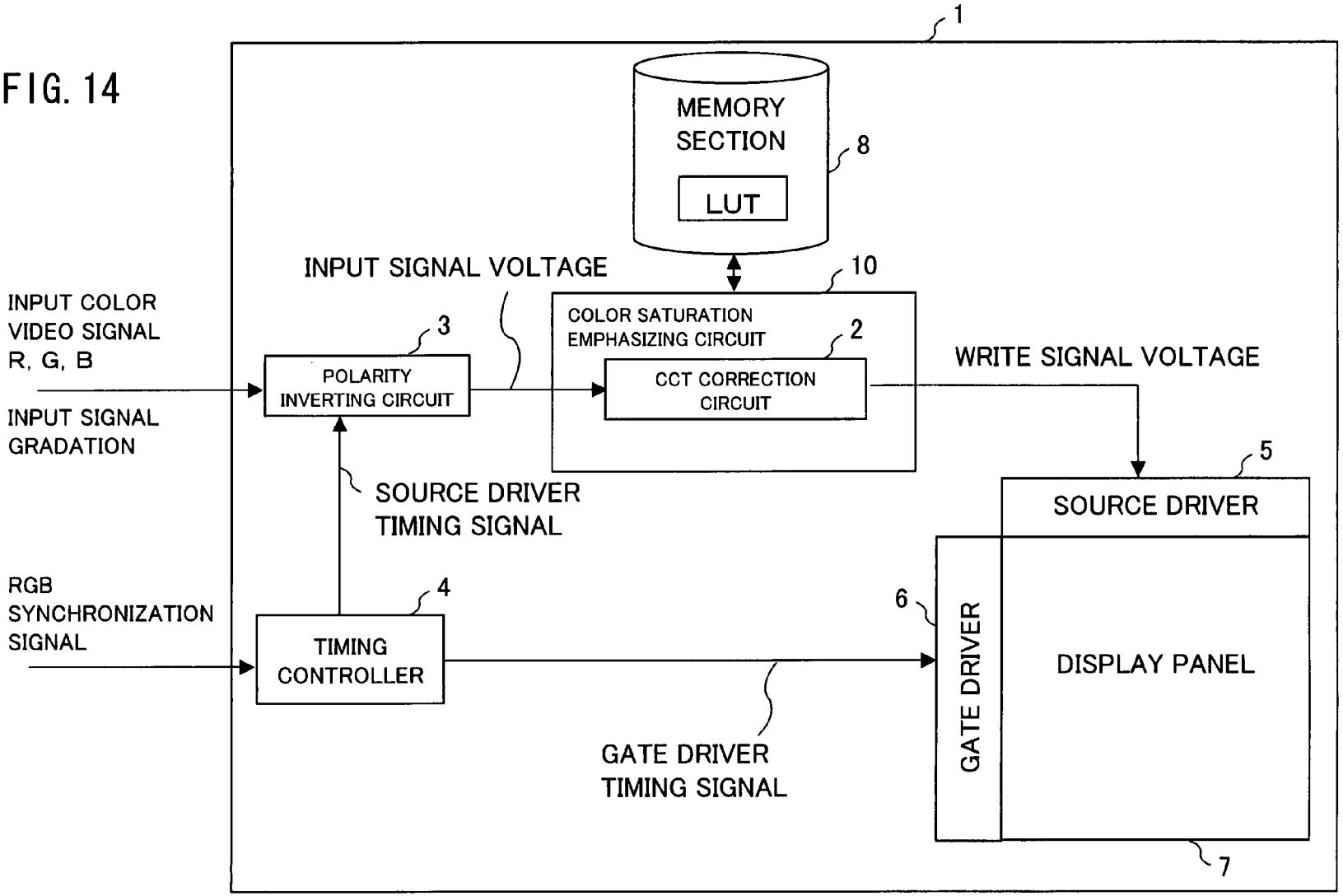
FIG. 14 is a block diagram illustrating an arrangement of a color display device in accordance with another embodiment of the present invention.
Figure 15A:
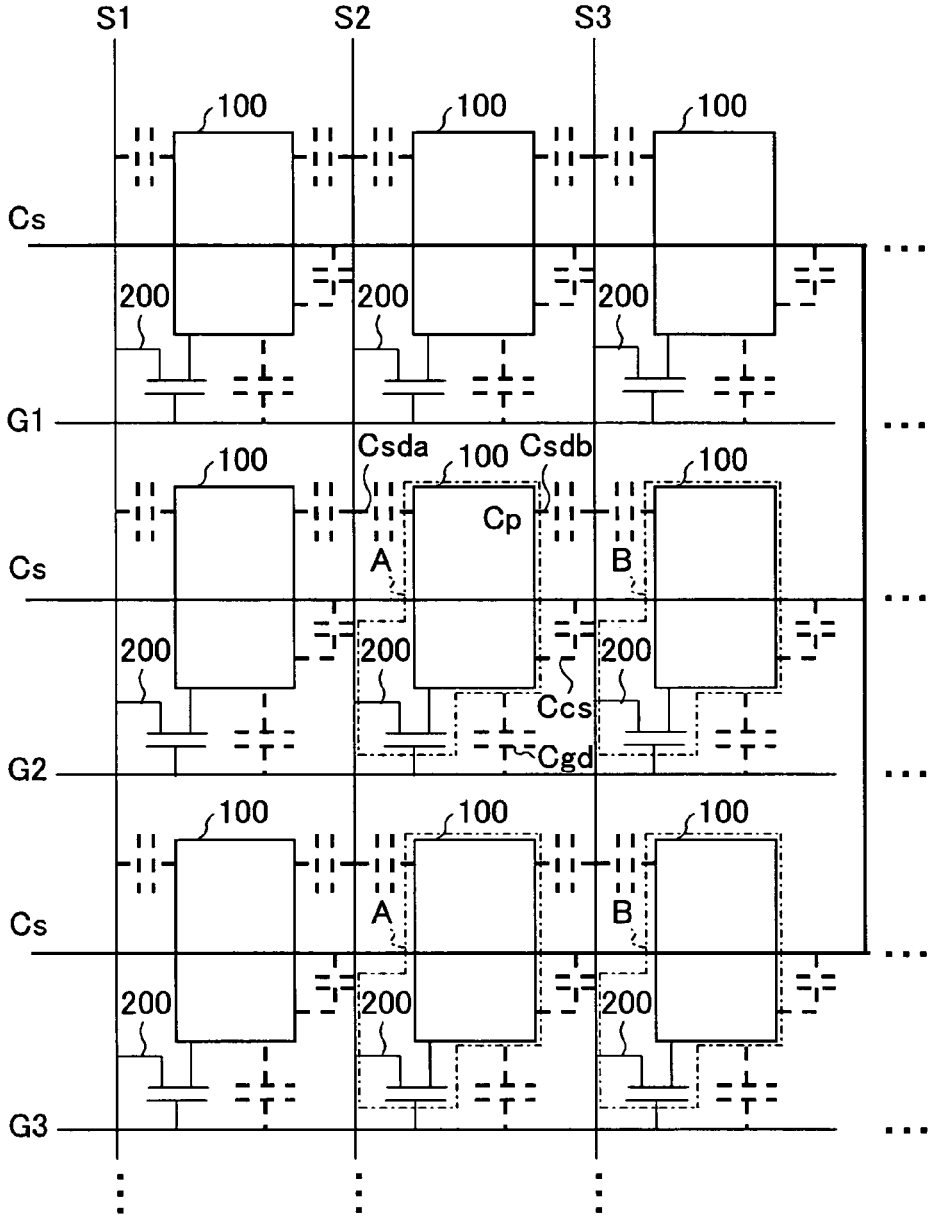
FIG. 15(*a*) is a diagram illustrating an arrangement of a display panel of a conventional liquid crystal display device, and FIG. 15(*b*) is a diagram illustrating voltages applied to a gate line.
Figure 15B:
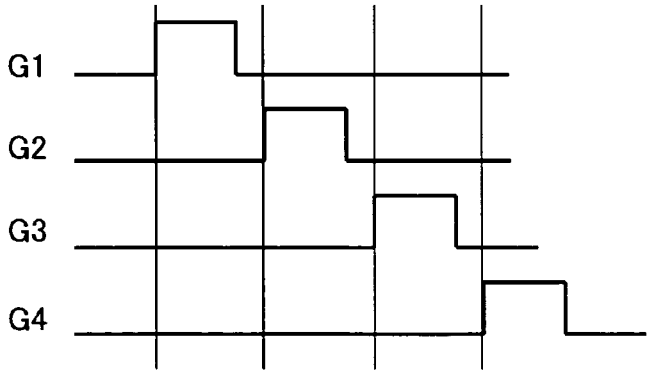

In the present color display device (display device) 1, as shown in FIG. 14, the CCT correction circuit 2 may be provided in an upstream of the polarity inverting circuit 3. The CCT correction circuit 2 of FIG. 14 corrects input signal voltages (analog data) supplied from the polarity inverting circuit 3, and outputs write voltage signals (analog data).

The timing controller 4 generates a source driver timing signal for driving the source driver 5 and a gate driver timing signal for driving the gate driver timing signal, in accordance with an inputted RGB synchronization signal. The source driver timing signal is inputted to the source driver 5 through the polarity inverting circuit 3.

The source driver 5 drives source lines connected through TFTs to the display pixels of the display panel 7, so that the write voltages determined by the polarity inverting circuit 3 are applied to the display pixels. The source driver 5 may be integrated with the polarity inverting circuit 3. The gate driver 6 drives gate lines connected through TFTs to the display pixels of the display panel 7.

Figure 1:
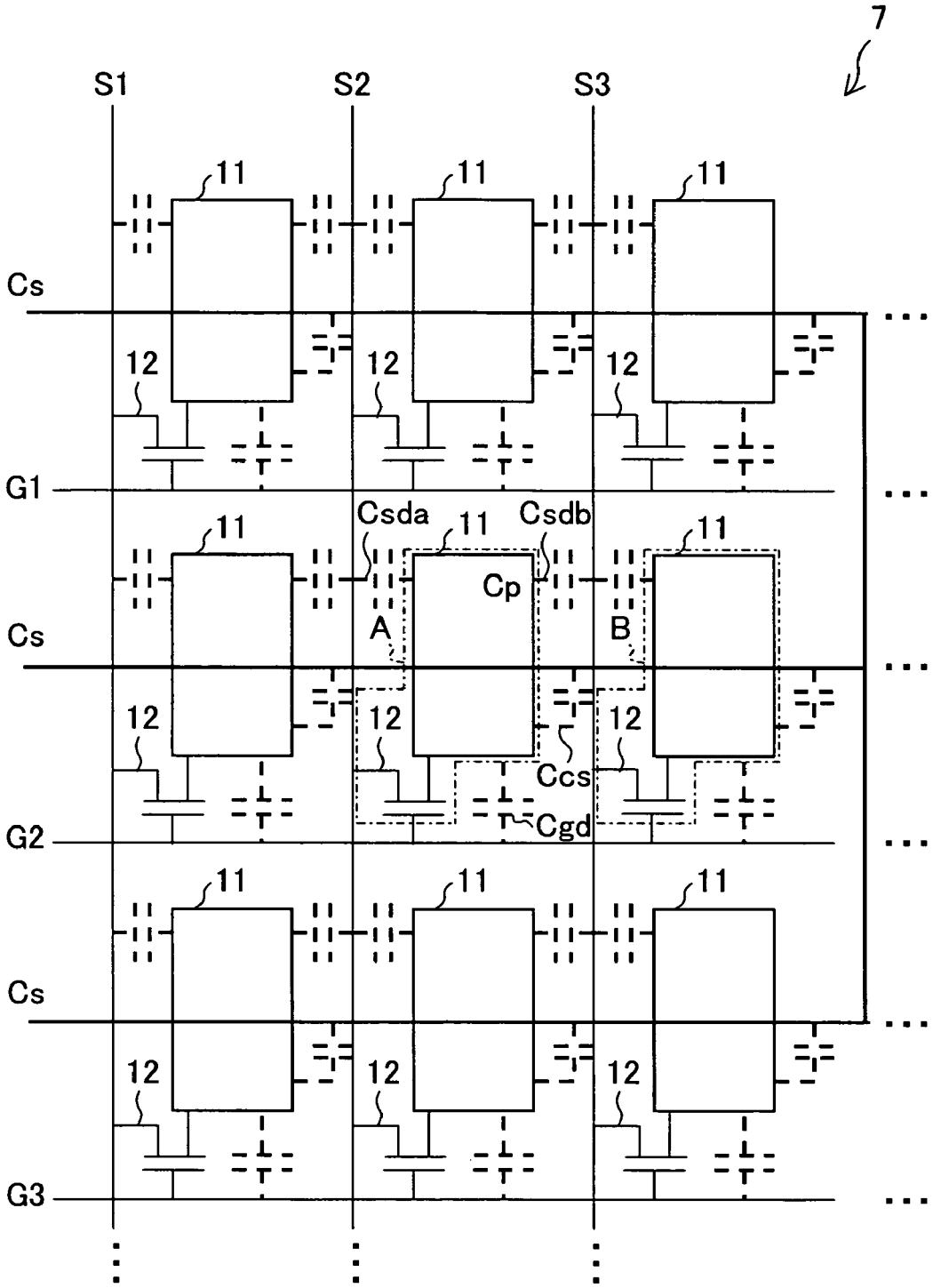
FIG. 1 is a plan view specifically illustrating an arrangement of a display panel of the color display device of FIG. 2.

The display panel 7 displays an image by driving, through a plurality of source lines and a plurality of gate lines, a plurality of display pixels arranged in matrix. Specifically, as shown in FIG. 1, source lines Si (i: integer) and gate lines Gj (j: integer) are provided to be orthogonal, and a display pixel including a display electrode 11 and a switching element 12 is provided at each intersection of a source line and a gate line.

Here, among display pixels, two display pixels are driven by the same gate line G2. As shown in FIG. 1, a first display pixel (A) is connected to a source line S2, and a second display pixel (B) is connected to a source line S3, which is adjacent to the source line S2 and forms a parasitic capacitance with the pixel electrode of the first display pixel (A). That is, the second display pixel is connected to the source line not connected to the first display pixel, out of the two source lines that overlap with (are adjacent to) the pixel electrode of the first display pixel. In this case, the following parasitic capacitances Csda, Csdb, Cgd, and Ccs are formed in the vicinity of the display pixel (A).

Parasitic capacitance Csda: parasitic capacitance formed between the display pixel (A) and the source line for driving the display pixel (A);

Parasitic capacitance Csdb: parasitic capacitance formed between the display pixel (A) and the source line for driving the display pixel (B);

Parasitic capacitance Cgd: parasitic capacitance formed between the display pixel (A) and the gate line for driving the display pixel (A); and Parasitic capacitance Ccs: parasitic capacitance formed between a common electrode line and the display pixel (A).

Therefore, if the CCT correction circuit 2 is not provided, and the display pixels 11 are driven by a conventional method, the problem of crosstalk is caused (that is, the display gradation of a display pixel differs from the desired gradation due to the influence of a voltage applied to a source line for driving another display pixel). For example, according to the arrangement of FIG. 1, the display gradation of the display pixel (A) (first display pixel) is influenced by a voltage applied to the source line S3, which drives the display pixel (B) (second display pixel).

To solve the problem of crosstalk caused as described above, the color display device 1 of the present embodiment includes the CCT correction circuit 2 (see FIGS. 2 and 14).

Figure 16A:
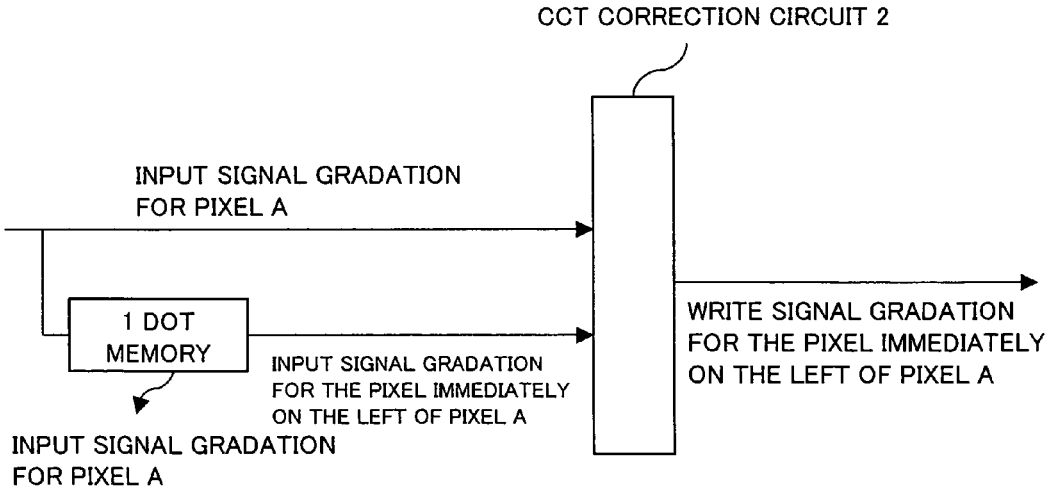
FIGS. 16(*a*) and 16(*b*) are block diagrams illustrating processing steps performed by a CCT correction circuit of the present invention.
Figure 16B:
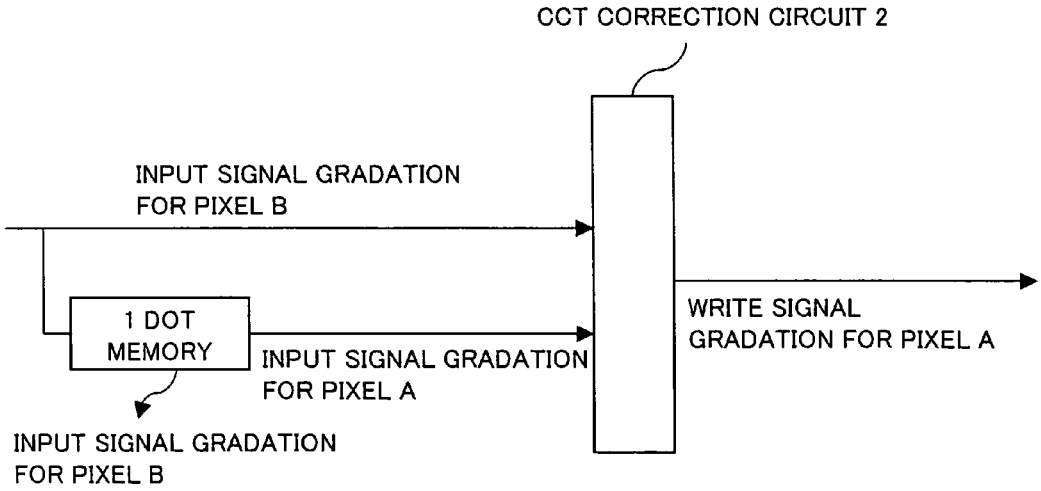
Figure 17:
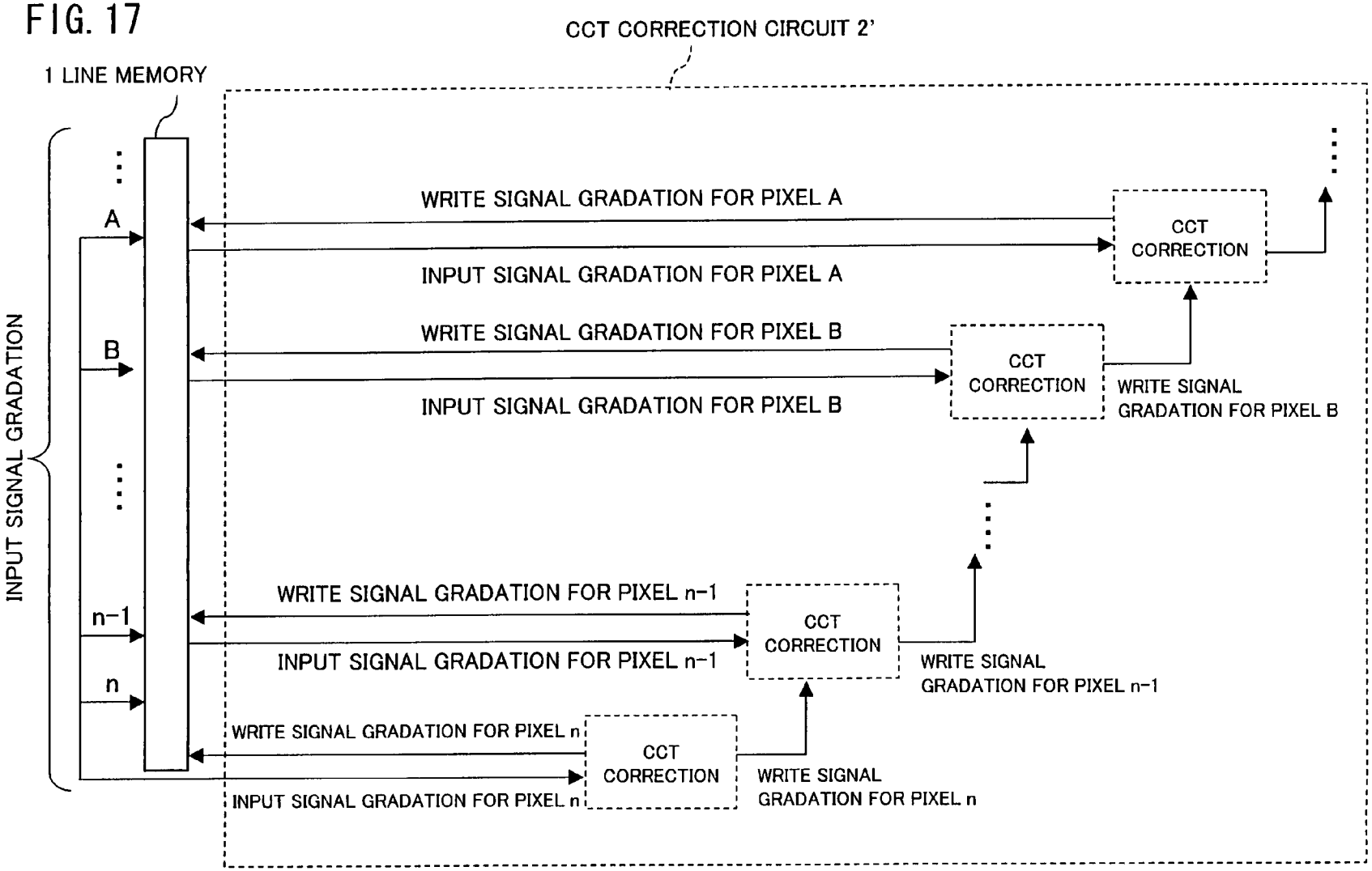
FIG. 17 is a block diagram illustrating processing steps performed by another CCT correction circuit of the present invention.

With reference to FIGS. 16 and 17, the following describes a step for outputting the write signals from the CCT correction circuit 2.

FIG. 16 is a block diagram illustrating a case where an input signal gradation for the display pixel (A) is corrected by the CCT correction circuit 2 in accordance with an input signal gradation for the display pixel (B), and the result is outputted to the polarity inverting circuit 3 as a write signal gradation for the display pixel (A).

First, the input signal gradation (on the left of FIG. 16(*a*)) for the display pixel (A) is recorded in a 1 dot memory, and is also inputted to the CCT correcting circuit 2 (FIG. 16(*a*)). Then, as shown in FIG. 16(*b*), the input signal gradation for the display pixel (B) is recorded in the 1 dot memory, and is also inputted to the CCT correcting circuit 2. At this time, the 1 dot memory outputs the input signal gradation for the display pixel (A), which is recorded first. The input signal gradation for the display pixel (A) is inputted to the CCT correcting circuit 2 along with the input signal gradation for the display pixel (B). In accordance with the input signal gradation for the display pixel (B), the CCT correction circuit 2 corrects the input signal gradation for the display pixel (A), which is inputted from the 1 dot memory. The CCT correction circuit 2 then outputs the result to the polarity inverting circuit 3, as a write signal gradation for the display pixel (A).

FIG. 17 is a block diagram illustrating a case where the input signal gradation for the display pixel (A) is corrected by a CCT correction circuit 2' in accordance with a write signal gradation for the display pixel (B), and the result is outputted to the polarity inverting circuit 3 as a write signal gradation for the display pixel (A).

If the scanning direction is the direction from the display pixel (A) toward the display pixel (B), first, an input signal gradation for a display pixel (n) connected to a source line provided at a scanning end (right end of FIG. 17) is inputted to the CCT correction circuit 2', and input signal gradations for all display pixels except the display pixel (n) are recorded in the 1 line memory. The input signal gradation for the display pixel (n) is corrected by the CCT correction circuit 2'. The result of correction is recorded in the 1 line memory, and is also outputted to the CCT correction circuit 2' as a write signal gradation for the display pixel (n). At this time, the CCT correction circuit 2' reads an input signal gradation for a display pixel (n-1) out of the 1 line memory, and corrects it in accordance with the write signal gradation for the display pixel (n). The result of correction is outputted as a write signal gradation for the display pixel (n-1), and is also recorded in the 1 line memory. This process is performed sequentially. When the write signal gradation for the display pixel (B) is recorded in the 1 line memory, and is also outputted to the CCT correction circuit 2', the CCT correction circuit 2' reads the input signal gradation for the display pixel (A) out of the 1 line memory, and corrects it in accordance with the write signal gradation for the display pixel (B). The result of correction is outputted as a write signal gradation for the display pixel (A), and is also recorded in the 1 line memory.

As a result, write signal gradations for all display pixels are recorded in the 1 line memory, and are outputted to the polarity inverting circuit 3 appropriately. At this time, if a direction of correction (recording into the 1 line memory) and the scanning direction for the lines are opposite, write signal gradations for the lines are outputted to the polarity inverting circuit 3 in accordance with the scanning direction for the lines.

If the scanning direction is the direction from the display pixel (B) toward the display pixel (A), first, an input signal gradation for a display pixel (n) connected to a source line provided at a scanning end (right end in FIG. 17) is inputted to a CCT correction circuit (not shown), and is outputted to the polarity inverting circuit 3 as a write signal gradation for the display pixel (n). When an input signal gradation for a display pixel (n-1) is inputted into the CCT correction circuit, it is corrected in accordance with the write signal gradation for the display pixel (n), and is outputted as a write signal gradation for the display pixel (n-1). This process is performed sequentially. When the write signal gradation for the display pixel (B) is inputted to the CCT correction circuit, and the write signal gradation for the display pixel (B) is outputted, the input display gradation for the display pixel (A), which is inputted at this time, is corrected in accordance with the write signal gradation for the display pixel (B). Then, the result of correction is outputted as a write signal gradation for the display pixel (A).

In this way, write signal gradations for the display pixels are sequentially outputted to the polarity inverting circuit. In the case of this scanning direction, the 1 line memory may be omitted.

2. PROCESSING FOR CORRECTING THE CROSSTALK

[2-1. Change of Luminance Balance]

To solve the problem of crosstalk caused as described above, the color display device 1 includes the CCT correction circuit 2. To explain procedures for correcting the input color video signals through the CCT correction circuit 2, the following describes how luminance balance changes with respect to each display pattern.

Figure 3:
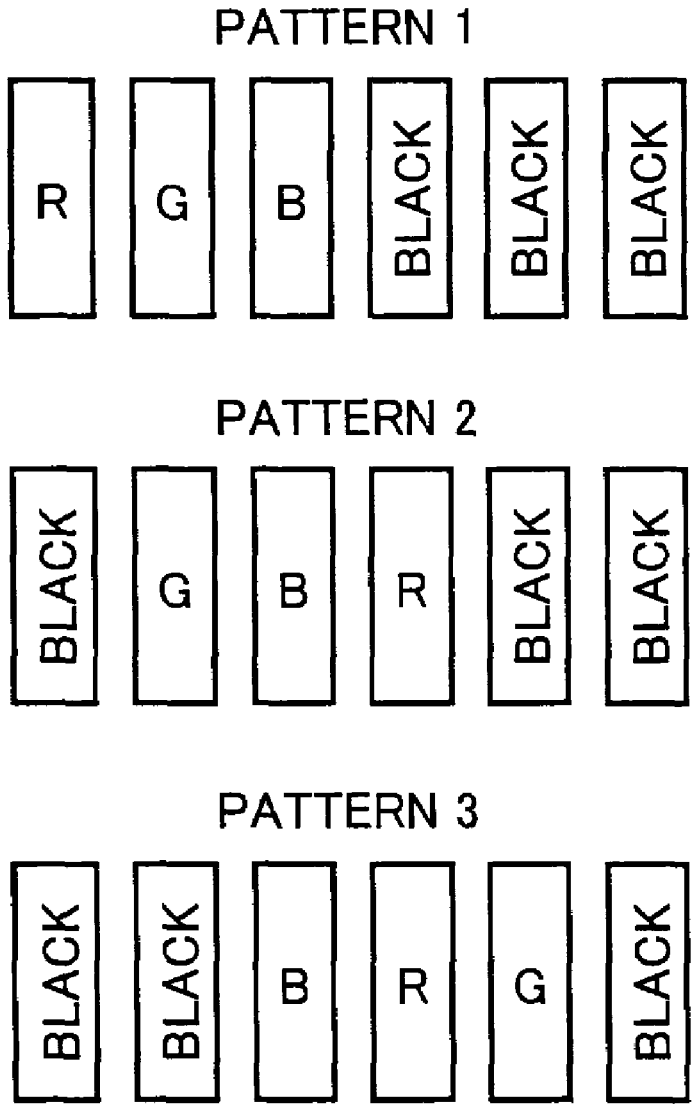
FIG. 3 is a diagram illustrating how display patterns change on the display panel of FIG. 1.

For example, suppose that patterns 1 to 3 shown in FIG. 3 are displayed by the display panel 7. Specifically, in pattern 1, six adjacent display pixels respectively display R, G, B, black, black, and black, beginning at the leftmost pixel. In pattern 2, six adjacent display pixels respectively display black, G, B, R, black, and black, beginning at the leftmost pixel. In pattern 3, six adjacent display pixels respectively display black, black, B, R, G, and black, beginning at the leftmost pixel.

The images respectively displayed by the patterns 1 to 3 on the display panel 7 must be identical. In reality, however, a voltage applied to a display pixel immediately on the left of a display pixel displaying black (display pixel whose gradation level is zero) is influenced by a voltage applied to the display pixel displaying black. As a result, the pixel immediately on the left displays at a slightly lower gradation level than the desired gradation level.

For example, in pattern 1, since the display pixel displaying B is immediately on the left of a display pixel displaying black, B is displayed at a slightly lower gradation level than the desired gradation level. Likewise, in pattern 2, R is displayed at a slightly lower gradation level than the desired gradation level, and, in pattern 3, G is displayed at a slightly lower gradation level than the desired gradation level. Thus, the luminance balance among a plurality of adjacent display pixels changes in accordance with the display patterns on the display panel.

Figure 4:
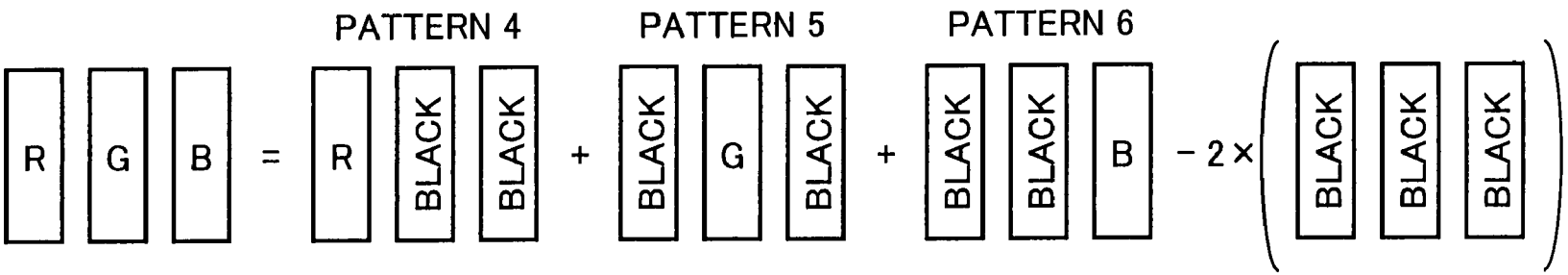
FIG. 4 is a diagram comparing theoretical while luminance and combined while luminance.

In the case where white is displayed by three adjacent display pixels, ideal white is displayed when the three display pixels respectively display R, G, and B, beginning from the left most pixel, as in the left side of the equation of FIG. 4.

Meanwhile, it must be possible to display white by switching the three adjacent display pixels to display either one of the following patterns 4 to 6, as in the right side of the equation of FIG. 4.

In the patterns 4 to 6, the colors respectively displayed by the three display pixels are, beginning from the left most pixel, pattern 4: R, black, black;

pattern 5: black, G, black; and pattern 6: black, black, B.

Theoretical white luminance must be equal to combined white luminance (red luminance+green luminance+blue luminance−2×black luminance). In reality, however, the combined luminance is lower than the theoretical white luminance. This is because the voltage applied to the display pixel of R, G, or B changes due to the influence of the voltage applied to the display pixel displaying black, as described above.

Figure 5:
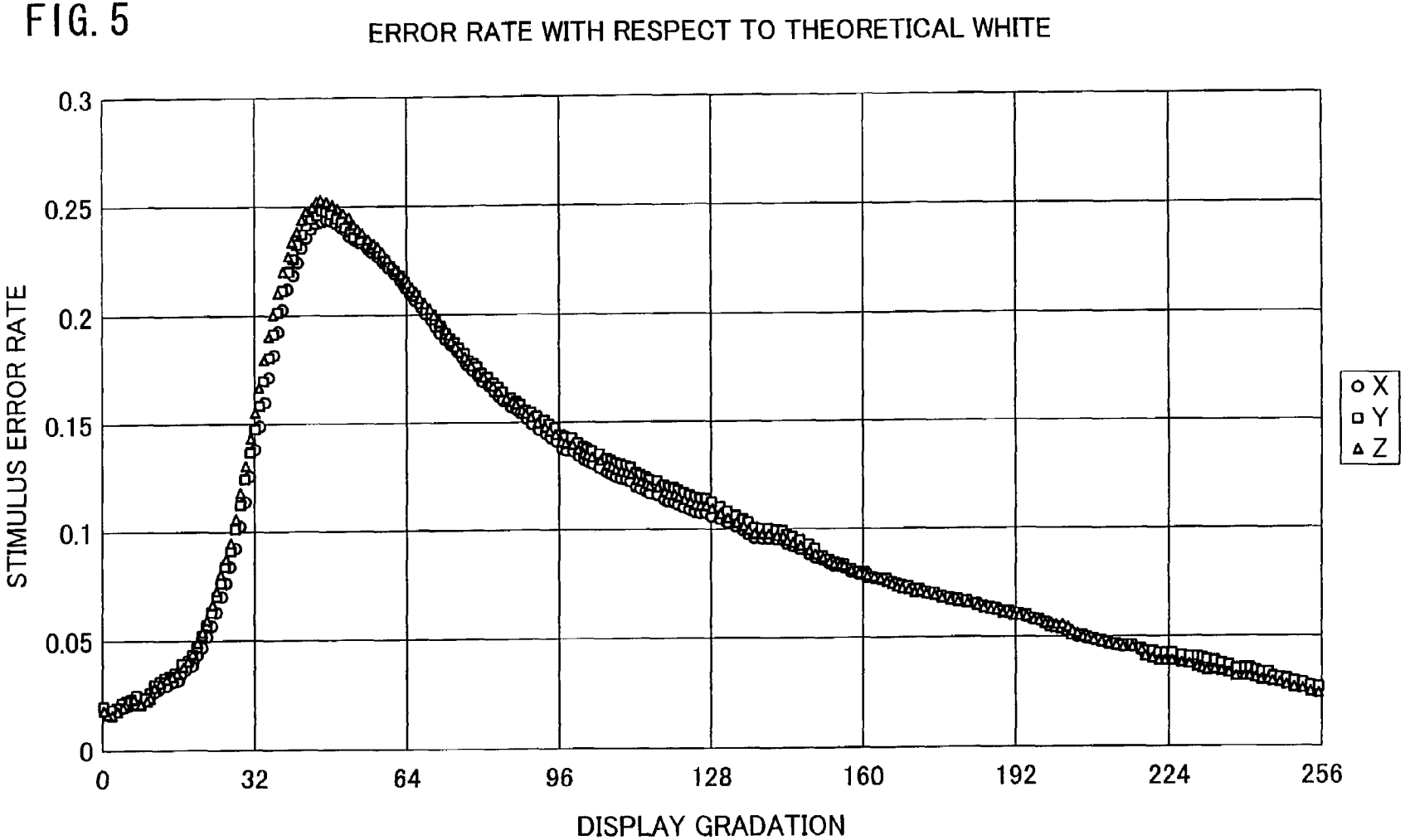
FIG. 5 is a graph illustrating the relationship between (i) the error rate of a stimulus value of the combined luminance with respect to the theoretical white luminance and (ii) the display gradation.

FIG. 5 shows the relationship between (i) the error rate of the stimulus value of the combined white luminance and (ii) the display gradation. In FIG. 5, the horizontal axis is the gradation level of a display pixel in the case where the gradation level of the display pixel adjacent thereto is zero. For example, if attention is paid to the display pixel (A) of the display panel arranged as in FIG. 1, the display gradation indicated by the horizontal axis of FIG. 5 is the gradation level LA of the display pixel (A) in the case where the gradation level LB of the display pixel (B) is zero.

For the purpose of explanation, the following discusses the case where the horizontal axis of FIG. 5 indicates the gradation level LA of the display pixel (A).

As shown in FIG. 5, the stimulus error rate changes drastically if the gradation level is on the low-gradation side. Specifically, in FIG. 5, the curve of the stimulus error rate shows a steep slope when the gradation level LA is between 0 and 128. On the other hand, if the gradation level LA is more than 128, the curve of the stimulus error rate shows a gentle slope, indicating that the stimulus error rate changes gradually.

Figure 6:
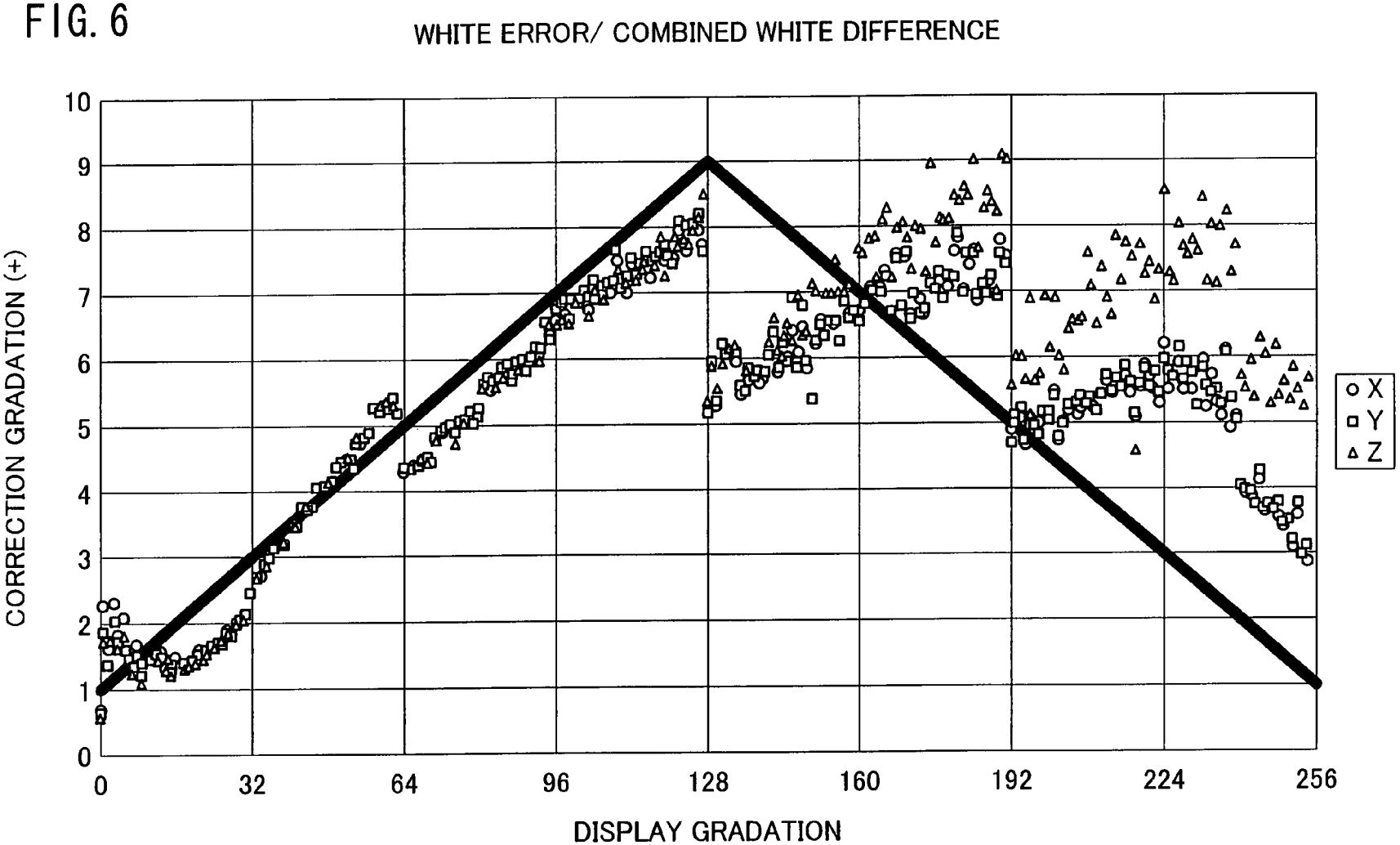
FIG. 6 is a graph illustrating the relationship between the correction gradation level and the display gradation.

A correction gradation level required to correct the combined white luminance of display pixels to the theoretical white luminance is calculated by dividing the error rate of the stimulus value in each gradation by the rate of change of the stimulus value in that gradation. FIG. 6 shows a graph plotting the relationship between the correction gradation level and the display gradation. Thus, FIG. 6 is obtained by dividing the stimulus value of FIG. 5 by a rate of change of the stimulus value in a closest gradation and converting an amount of attraction into an actual gradation.

As shown in FIG. 6, if, for example, the gradation level LA of the display pixel (A) is zero, the correction gradation level is substantially zero. As the gradation level LA approaches 128, the correction gradation level LA increases. On the other hand, if the gradation level LA exceeds 128, there is no longer clear correlation between the gradation level LA and the correction gradation level.

Like FIG. 5, FIG. 6 shows the relationship between the gradation level LA and the correction gradation on the assumption that the gradation level LB is zero. If the gradation level LB is higher than zero, the correction gradation level decreases by a certain amount that depends on the value of LB. If LB≧LA, the correction gradation level is zero.

As can be seen from FIG. 5, the error rate changes drastically on the low-gradation side. This indicates that, if the display pixel (A) displays at a low-level gradation, it is really necessary to correct the combined luminance accurately.

Therefore, by using, as shown in FIG. 6, a linear line to indicate the relationship between the display gradation level and the correction gradation level in the range where the gradation level is between 0 and 128, it is possible to calculate an appropriate correction gradation in accordance with the gradation level. This makes it possible to correct the combined luminance accurately in the case where the gradation level LA is on the low-gradation side.

On the other hand, if the gradation level LA is on the high-gradation side (e.g. not lower than 128), there is no longer a clear correlation between the gradation level LA and the correction gradation level. Therefore, if the gradation level LA is more than 128, a relatively rough correction is performed by setting the correction gradation level to a constant value.

Figure 7:
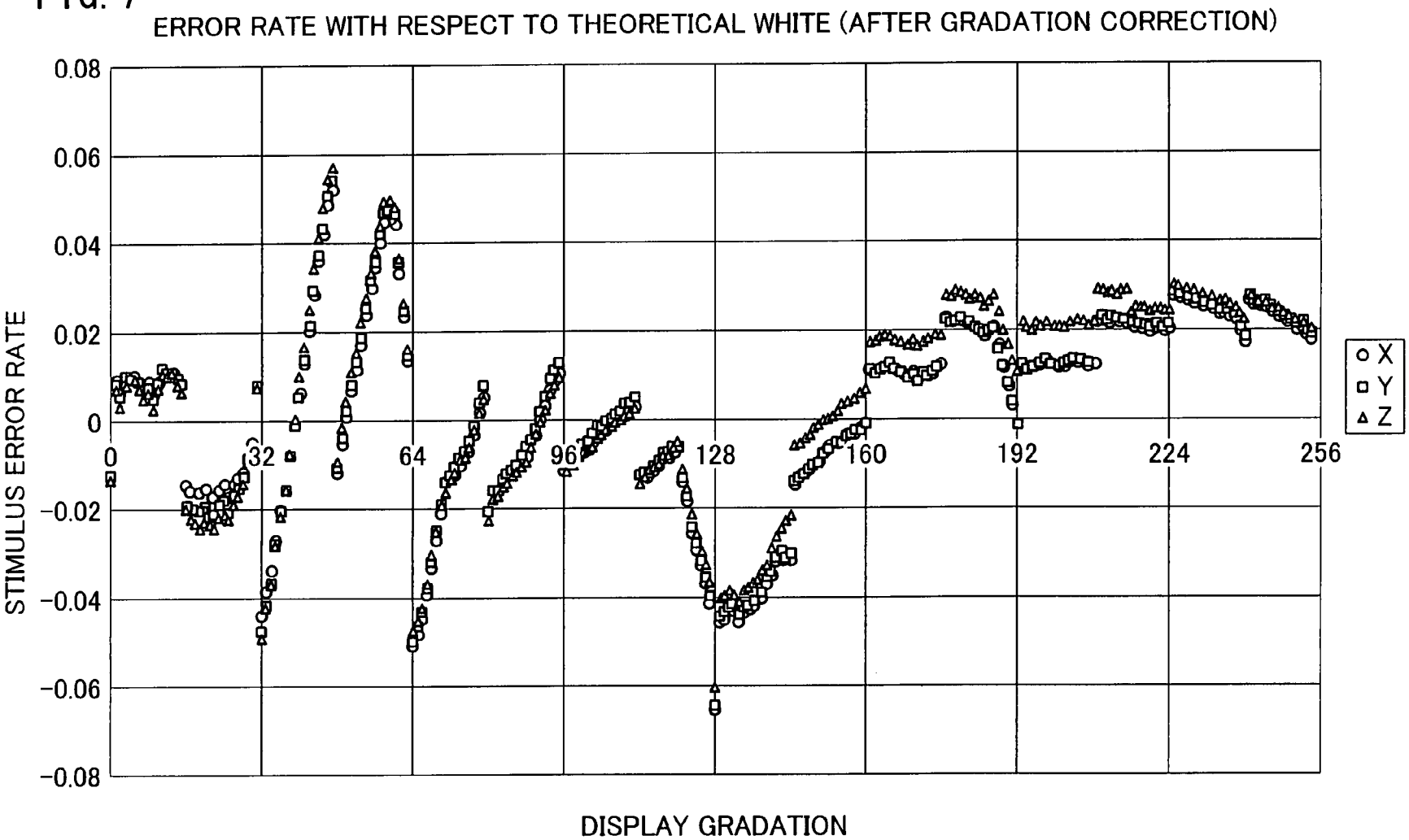
FIG. 7 is a graph illustrating the relationship between the display gradation LA and the stimulus error rate in the case where the correction gradation level of FIG. 6 is added to the gradation level of the display pixel (A).

FIG. 7 shows the relationship between the display gradation level LA and the stimulus error rate in the case where the correction gradation level is added to the gradation level of the display pixel (A). As shown in FIG. 7, by adding the correction gradation level, the stimulus error rate, which is 25% at maximum before the addition of the correction gradation level, is reduced to 5%.

[2-2. Correction of Crosstalk Using Gradation Level Data]

From the discussion above, it can be concluded that the amount of crosstalk can be reduced if the write signal gradation for the display pixel (A) is determined by correcting, using the CCT correction circuit, the input signal gradation for the display pixel (A) in accordance with the input signal gradation or the write signal gradation for the display pixel (B). If the input signal gradation for the display pixel (A) is corrected in accordance with the input signal gradation or the write signal gradation for the display pixel (B), it is possible to take into consideration, in determining the write signal gradation for the display pixel (A), the display pixel (A) is influenced by the display pixel (B) due to the parasitic capacitances. Therefore, it is possible to reduce the amount of crosstalk caused between the parasitic capacitance Csd and the display pixel, and thereby correct the color balance of an image displayed by the display device.

Specifically, the correction is performed so that the input gradation level for the display pixel (A) is corrected to $$Lout=LA+F(LA, LB)$$

where LA is the gradation level of the display pixel (A) represented by digital data, LB is the gradation level of the display pixel (B) also represented by digital data, and F(LA, LB) is a function using LA and LB as input values.

By thus correcting the gradation level LA, the input signal gradation for the display pixel (A) is corrected by using the gradation levels represented by digital data. Therefore, the crosstalk can be reduced by a simple process. If the voltage to be applied to the display pixel (A) is corrected by using analog data representing a voltage to be applied, a more complex process could be required, involving a larger number of bits then in the case where digital data is used. Such complication of the process can be avoided if the correction is performed by using digital data.

If LA is lower than a predetermined threshold value, it is preferable that F(LA, LB) is defined by $$F(LA, LB)=k(LA-LB), \text{ where } k>0$$

If LA is higher than the threshold value, it is preferable that F(LA, LB) is defined as a function that outputs a constant value.

As shown in FIG. 6, the correction value F(LA, LB), which is to be added to LA in order to reduce the crosstalk, shows monotone increase in accordance with the value of LA, until LA reaches the predetermined threshold value (128). If LA is higher than the threshold value (128), there is no longer clear correlation between LA and F(LA, LB). Moreover, since the error rate of the stimulus value decreases as shown in FIG. 5, the crosstalk can be reduced by a relatively rough correction (e.g. outputting Lout after adding a constant value to LA).

Therefore, by defining F(LA, LB) as described above, Lout can be calculated by a simple process.

In a preferred arrangement, a look-up table is used. The look-up table stores associated values of LA and F(LA, 0) with respect to each LA (each of a plurality of integers extracted from within a range of zero to the maximum gradation level). The value of F(LA, LB), where LA is a value not stored in the look-up table, is interpolated in accordance with the value of LA stored in the look-up table, the value of F(LA, 0) associated with the value of LA, and the values of LA and LB that satisfy F(LA, LB)=0.

According to this arrangement, the value of F(LA, LB) can be determined by using the look-up table. Therefore, by preparing the look-up table in advance with respect to each kind of display device, and storing the look-up table in the memory section 8 (see FIG. 2), it is possible to determine an appropriate value of F(LA, LB) in accordance with the kind of the display device.

If LA>LB, it is preferable to perform the interpolation by linear interpolation. This is because interpolation by linear line is the simplest interpolation method.

If LA<LB, it is preferable to define F(LA, LB)=0.

If LA<LB, the gradation level of the display pixel (A) is low. In this case, even if crosstalk is caused between a source line and the first display pixel, the influence of the crosstalk on the display pixel (A) is small. Therefore, if LA<LB, it is not necessary to determine the correction value F(LA, LB). Thus, if LA<LB, it is preferable to define F(LA, LB)=0.

[2-3. Correction of Crosstalk Using Voltage Data]

According to the foregoing method, the write signal gradation for the display pixel (A) is determined by using the input signal gradation level LA for the display pixel (A) and the gradation level LB (input signal gradation or write signal gradation) of the display pixel. However, it is not always necessary to perform this process. Instead, a write signal voltage for the display pixel (A) may be determined in accordance with analog data representing a write signal voltage for the display pixel (A) and analog data representing a voltage to be applied to the display pixel (B) (input signal voltage or write signal voltage). A procedure for this correction is as follows. Like the correction using digital data representing gradation levels, the correction using analog data representing voltages to be applied are executed by the CCT correction circuit. However, since the CCT correction circuit must receive the analog data representing voltages to be applied to pixels, it is necessary to provide the polarity inverting circuit 3 in the upstream of the CCT correction circuit, as shown in FIG. 14.

In order to perform correction by using the analog data representing the voltages to be applied, a correction value F(g) is calculated, and added to an input signal gradation for the display pixel (A), so as to determine a write signal gradation for the display pixel (A). The correction value F(g) is represented by $$F(g)=Csd\cdot(Ugad-Ubad)/Cp\cdot(U(g+1)-U(g))$$

where Cp is a capacitance value of the display pixel (A) (a capacitance formed between the pixel electrode of the display pixel (A) and a storage capacitor electrode), Csd is a capacitance value of a parasitic capacitance formed between a source line S3, which is connected to the display pixel (B), and the pixel electrode of the display pixel (A), U(g) is an input signal voltage for the first display pixel (A) when a level of an input signal gradation is g, Ugad is an input signal voltage or a write signal voltage for the display pixel (B), and Ubad is a voltage to be applied to a common electrode, which is opposed to the pixel electrodes of the display pixels (A) and (B) (an input signal voltage for the display pixel (A) when black is to be displayed by the display pixel (A)). A voltage corresponding to the write signal gradation is used as a write signal voltage for the display pixel (A). In particular, it is possible to lower the correction value F(g) by setting Csd/Cp to a low value about 0.020.

Note that Cp is a value obtained by adding Ccs, Csda, Csdb, and Cgd to the capacitance of the liquid crystal of the display pixel (A). However, since the capacitance of the liquid crystal (capacitance value) is dominant, Cp may be equal to the capacitance of the liquid crystal, or may be a value obtained by adding Ccs, Csda, Csdb, Cgd, and at least one of the capacitances formed within the display pixel (A) to the capacitance of the liquid crystal.

Alternatively, if it is necessary to apply an effective voltage value Va to the display pixel (A) in order to display a desired gradation, a voltage V(A) is used as the write signal voltage for the display pixel (A). The voltage V(A) is represented by $$V(A)=(Cp\times Va-Cgd\times Vg-Csdb\times V(B)+Ccs\times Vc)/(Cp+Csda)$$

where V(B) is an input signal voltage or a write signal voltage for the display pixel (B), Csda is a capacitance value of a parasitic capacitance formed between the source line S2, which is connected to the display pixel (A), and the pixel electrode of the display pixel (A), Csdb is a capacitance value of the parasitic capacitance formed between the source line S3, which is connected to the display pixel (B), and the pixel electrode of the display pixel (A), Cgd is a capacitance value of a parasitic capacitance formed between a gate line G2, which is connected to the display pixel (A), and the pixel electrode of the display pixel (A), Ccs is a capacitance value of a parasitic capacitance formed between a storage capacitor electrode Cs, which is provided so as to correspond to the display pixel (A), and a drain electrode of the switching element of the display pixel (A), Vg is a voltage to be applied to the gate line G2, Vc is a voltage to be applied to the storage capacitor electrode Cs, and Cp is a capacitance value of the display pixel (A).

[2-4. Correction of Crosstalk by Color Saturation Emphasis Process]

Thus correcting the gradation level of the display pixel (A) in accordance with the gradation level of the display pixel (B) has something in common with color saturation emphasizing process disclosed in Publication 2. In Publication 2, input color video signals (R-signal, G-signal, and B-signal), which respectively have gradation levels R, G, and B, are corrected so as to have gradation levels represented by $$R'=R+Krg(R-G)+Krb(R-B)$$

$$G'=G+Kgr(G-R)+Kgb(G-B)$$

$$B'=B+Kbr(B-R)+Kbg(B-G)$$

where Krg, Krb, Kgr, Kgb, Kbr, and Kbg are positive constants or variables that vary within a range of not lower than zero.

Publication 2 further teaches an arrangement of varying Krg, Krb, Kgr, Kgb, Kbr, and Kbg so that (i) Krg and Krb are maximized when R is at an intermediate gradation level, and minimized when R is at a gradation level of white or black, (ii) Kgr and Kgb are maximized when G is at an intermediate gradation level, and minimized when G is at a gradation level of white or black, and (iii) Kbr and Kbg are maximized when B is at an intermediate gradation level, and minimized when B is at a gradation level of white or black.

However, the correction function for emphasizing color saturation does not consider crosstalk among pixels. On the other hand, the crosstalk correction function refers to a gradation of an adjacent pixel, but is similar to the function used for emphasizing color saturation. Therefore, by combining the crosstalk correction of the present invention with the conventional correction for emphasizing color saturation, it is possible to reduce crosstalk at a low cost. That is, improved display quality by a color balance adjustment function H (the function for emphasizing color saturation+the function for correcting crosstalk), which considers both emphasizing color saturation and correcting crosstalk, can be attained at the same cost as the conventional color saturation emphasis.

The processing using the adjustment function H is executed by the color saturation emphasizing circuit 10 provided to the color display device 1 of the present embodiment.

Based on the foregoing formula for the color saturation emphasizing process (specifically, by using LA, LB, and LC to express R, G, B, Krg, Krb, Kgr, Kgb, Kbr, and Kbg), F(LA, LB) can be set as follows:

$$F(LA, LB)=k_{LB}(LA-LB)+k_{LC}(LA-LC)$$

where LA is the gradation level of the display pixel (A), LB is the gradation level of the display pixel (B), LC is a gradation level of a display pixel other than the display pixel (A) and the display pixel (B) in a picture element including the display pixel (A) and the display pixel (B), $k_{LB}$ is a function of LB, $k_{LC}$ is a function of LC, and there exists such p, which satisfies 0>p and p<255, that k(0)=certain constant value, k(MAX)=0, and k(p)=local maximum value, where MAX is a maximum value of a gradation level displayed.

Thus, the crosstalk can be reduced by the conventional color saturation emphasizing process. Therefore, by causing a computer provided inside or outside the display device to execute a program for executing the conventional color saturation emphasizing process, it is possible to reduce the crosstalk at low cost.

3. EXAMPLES OF COLOR ALLOCATION OF DISPLAY PANEL

The following describes color allocation examples for a plurality of display pixels for more efficiently reducing the crosstalk by the driving method of the present embodiment. In the color arrangement examples 1 to 3, three colors R, G, and B are respectively allocated to the pixels. However, three colors of cyan, magenta, and yellow may be respectively allocated to the pixels.

Color Allocation Example 1

Allocation in Stripes

In color allocation example 1, R, G, and B are allocated to a plurality of pixels in stripes, in accordance with the stripes formed by source lines.

Figure 8:
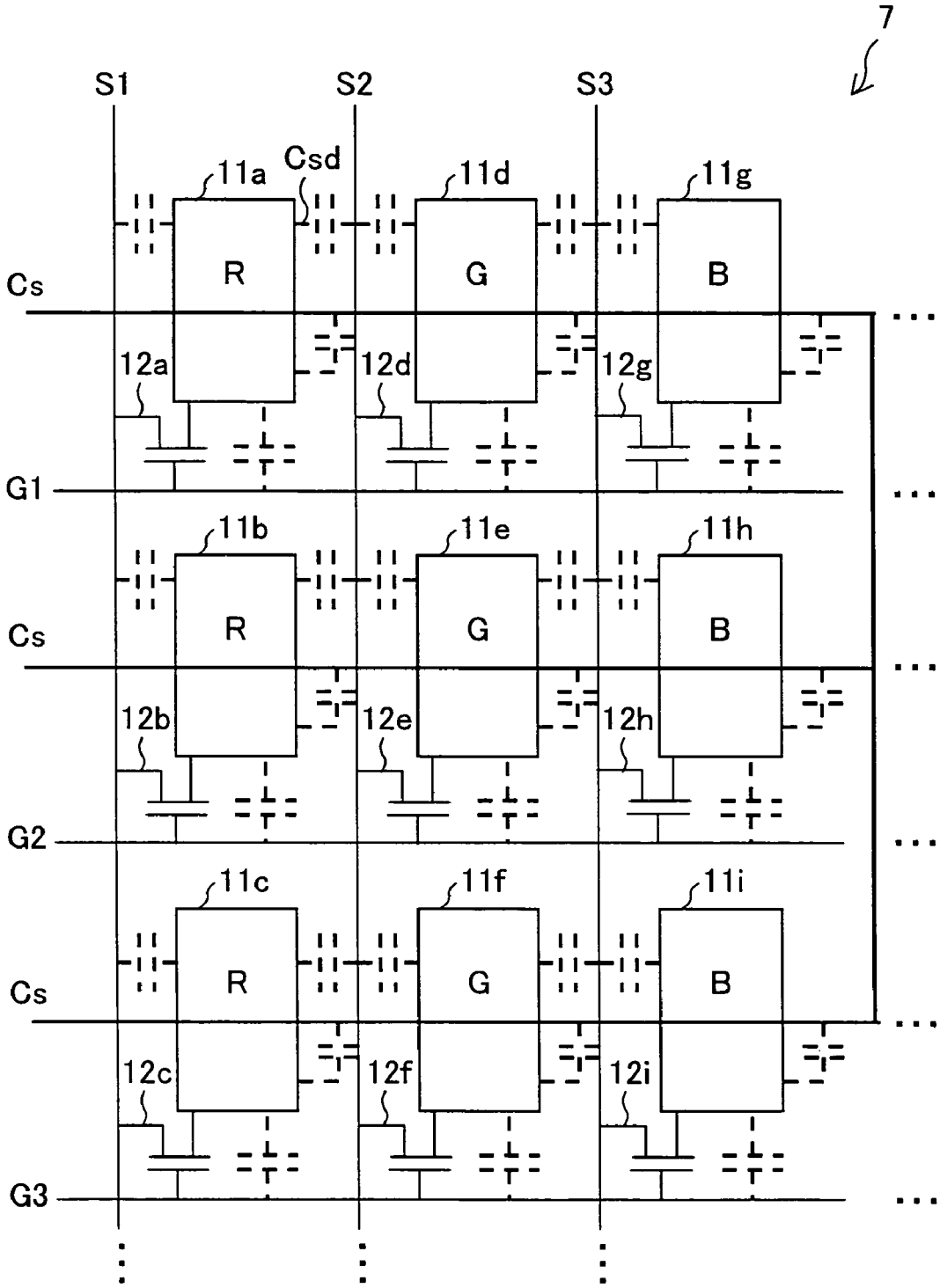
FIG. 8 is a plan view illustrating the display panel of FIG. 1 in the case where colors are allocated according to color allocation example 1.

As shown in FIG. 8, on the display panel 7, a plurality of source lines Si (i: integer) are arranged in parallel with each other. In color allocation example 1, display colors are allocated to the plurality of display pixels as follows, for example.

A display pixel included in the display panel 7 (e.g. display pixel 11*a*) is set as a first display pixel. The display pixel 11*a* is a pixel selected arbitrarily from the display pixels of the display panel 7. The display pixel 11*a* is connected to the source line (first source line) S1 through a switching element 12*a*. The source line (first source line) S1 is connected through switching elements to a column including a plurality of display pixels. This column is set as a first display pixel column. For example, display pixels 11*b* and 11*c* are connected respectively through switching elements 12*b* and 12*c* to the source line S1. Therefore, the display pixels 11*b* and 11*c* belong to the first display pixel column.

The plurality of display pixels belonging to the first display pixel column are set to display one of the three colors R, G, and B. For example, as shown in FIG. 8, the display pixels 11*a*, 11*b*, and 11*c*, each of which belongs to the first display pixel column, are set to display R.

What is set as a second display pixel is a display pixel 11*d*, which is (i) driven by the gate line G1, which also drives the display pixel 11*a*, and (ii) connected, through the switching element 12*d*, to the source line (second source line) S2, which is connected to the display pixel 11*a* through the parasitic capacitance Csd. The source line S2, which is connected to the display pixel 11*d* through the switching element 12*d*, is connected through switching elements to a column including a plurality of pixels. This column is set as a second display pixel column. For example, display pixels 11*e* and 11*f* are connected respectively through switching elements 12*e* and 12*f* to the source line S2. Therefore, the display pixels 11*e* and 11*f* belong to the second display pixel column.

The second display pixel column is set to display one of the three colors R, G, and B other than the display color of the first display pixel column. For example, as shown in FIG. 8, the display pixels 11*d*, 11*e*, and 11*f*, each of which belongs to the second display pixel column, are set to display G.

The source line S2 is adjacent to the source line S1 on one side, and to the source line (third source line) S3 on the other side. The source line S3 is connected through switching elements to a column including a plurality of display pixels. This column is set as a third display pixel column. For example, as shown in FIG. 8, the display pixels 11*g*, 11*h*, and 11*i*, which are connected to the source line S3 respectively through switching elements 12*g*, 12*h*, and 12*i*, belong to the third display pixel column.

The third display pixel column is set to display one of the colors R, G, and G that is not set as a display color of the first display pixel column or the second display pixel column. For example, as shown in FIG. 8, the display pixels 11*g*, 11*h*, and 11*i*, each of which belongs to the third display pixel column, are set to display B.

The display colors of the first display pixel column, the second display pixel column, and the third display pixel column are not limited to the foregoing example. For instance, if the first display pixel column is set to display R, the rest of the colors may be allocated so that the second display pixel column displays B and the third display pixel column displays G.

According to the foregoing arrangement, crosstalk could occur between the display pixel 11*a* and the display pixel 11*d*, due to the influence of the voltage inputted to the source line S2, for example.

However, the plurality of display pixels of the first display pixel column are set to display one of the colors R, G, or B. Therefore, even if such crosstalk that has significant influence on the user's vision occurs between the display pixel 11*a* and the display pixel 11*d*, it is possible to distribute the crosstalk appropriately within the first display pixel column. In this way, it is possible to lower the crosstalk level of the color display device as a whole, and thereby correct the color valance of an image displayed by the display device.

Color Allocation Example 2

Allocation in Oblique Stripes

In color allocation example 2, R, G, or B is allocated to a plurality of display pixels as follows. In explaining color allocation example 2, it is necessary to set a first display pixel group including three display pixels in the display device and a second display group including three display pixels not included in the first display pixel group as follows, for example.

Figure 9:
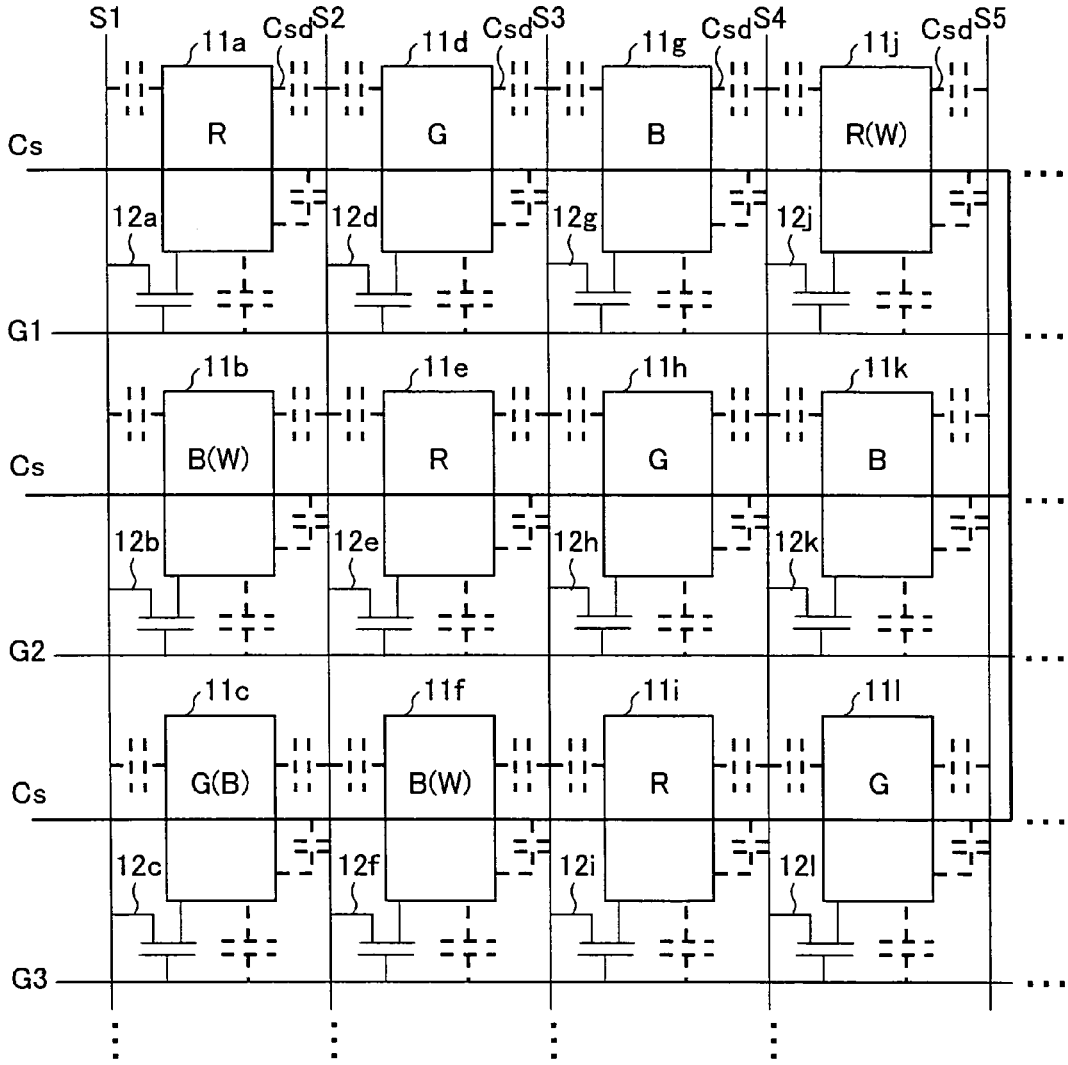
FIG. 9 is a plan view illustrating the display panel of FIG. 1 in the case where colors are allocated according to color allocation example 2.

The three display pixels of the first display pixel group are respectively set as (i) a third display pixel that is driven by the first gate line and is connected, through a switching element, to a source line connected to the second display pixel through a parasitic capacitance, (ii) the first display pixel, and (iii) the second display pixel. For example, if the display pixel 11*a* is set as the first display pixel and the display pixel 11*d* is set as the second display pixel as shown in FIG. 9, the display pixel 11*g* is set as the third display pixel. This is because the display pixel 11*g* is driven by the gate line (first gate line) G1 and connected through the switching element 12*g* to the source line 3, which is connected to the display pixel 11*d* through the parasitic capacitance Csd.

In the claims and specification, a set of three display pixels that are driven by the same gate line and that are adjacent to each other in the direction of the gate line is expressed as "display picture element". If a pixel includes a plurality of sub pixels, the term "display pixel" used in the specification refers to a sub pixel, and the term "picture element" used in the claims refers to a set of sub pixels.

The display pixels 11*a*, 11*d*, and 11*g* are set to display R, G, and B, so that display colors of these display pixels are different from each other. For example, as shown in FIG. 9, the display pixel 11*a* is set to display R, the display pixel 11*d* is set to display G, and the display pixel 11*g* is set to display B.

Meanwhile, the three display pixels of the second display pixel group are respectively set as fourth, fifth, and sixth display pixels. The fourth display pixel is connected, through a switching element, to (i) the source line connected to the first display pixel through a switching element and (ii) the second gate line, which is adjacent to the first gate line. The fifth display pixel is connected, through a switching element, to (i) the source line connected to the second display pixel through a switching element and (ii) the second gate line. The sixth display pixel is connected, through a switching element, to (i) the source line connected to the third display pixel through a switching element and (ii) the second gate line. For example, if the display pixel 11*a* is set as the first display pixel as described above, the display pixel 11*b* is set as the fourth display pixel. This is because the display pixel 11*b* is connected, through the switching element 12*b*, to (i) the source line S1, which is connected to the display pixel 11*a* through the switching element 12*a* and (ii) the gate line (second gate line) G2, which is adjacent to the gate line G1. Likewise, the display pixel 11*e* is set as the fifth display pixel, and the display pixel 11*h* is set as the sixth display pixel.

The fourth display pixel is set to display the color displayed by the third display pixel; the fifth display pixel is set to display the color displayed by the first display pixel; and the sixth display pixel is set to display the color displayed by the second display pixel. Specifically, as shown in FIG. 9, if the display pixel 11*a* is set to display R, the display pixel 11*d* is set to display G, and the display pixel 11*g* is set to display B, then the display pixel 11*b* is set to display B, the display pixel 11*e* is set to display R, and the display pixel 11*h* is set to display G.

Figure 10:
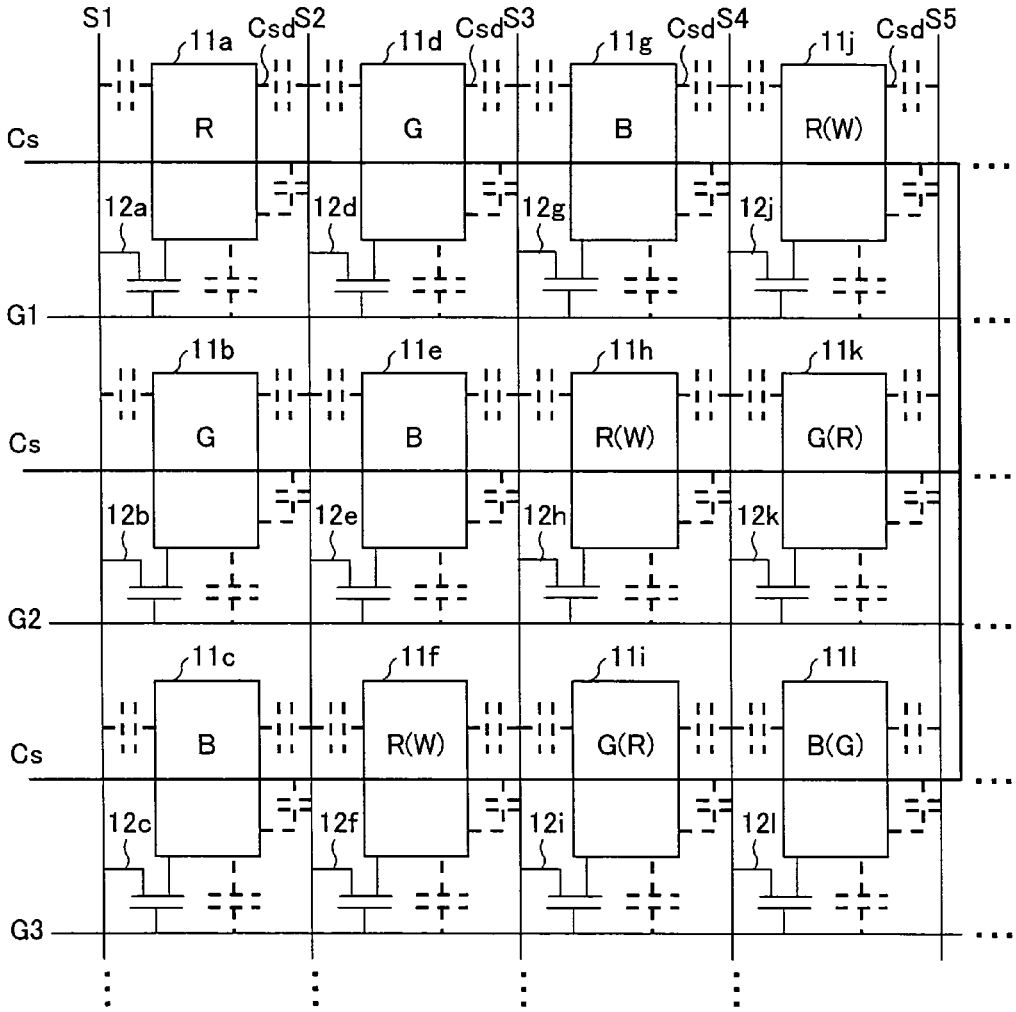
FIG. 10 is a plan view illustrating the display panel of FIG. 1 in the case where colors are allocated according to color allocation example 2.

Alternatively, the colors may be allocated so that the fourth display pixel displays the color displayed by the second display pixel, the fifth display pixel displays the color displayed by the third display pixel, and the sixth display pixel displays the color displayed by the first display pixel. Specifically, as shown in FIG. 10, the colors may be allocated so that the display pixel 11*b* displays G, the display pixel 11*e* displays B, and the display pixel 11*h* displays R.

In the foregoing example, the three display pixels of the first display pixel group are set to display R, G, and B, respectively in this order. However, the colors may be allocated in other orders (e.g. in the order of R, B, and G).

The foregoing arrangement has the following advantage. If such crosstalk that has significant influence on the user's vision occurs between the display pixel 11*a* and the display pixel 11*d*, the crosstalk could occur between other two display pixels.

However, according to the foregoing arrangement, the display colors R, G, and B of the three display pixels driven by the same source line are set in different orders in the first display pixel group and in the second display pixel group. Thus, display colors are allocated to the display pixels evenly, without deteriorating the color balance of the color display device as a whole.

Therefore, even if such crosstalk that has significant influence on the user's vision occurs between two pixels other than the display pixel 11*a* and the display pixel 11*d*, it is possible to distribute the crosstalk at right balance within the color display device. In this way, it is possible to lower the crosstalk level of the color display device as a whole, and thereby correct the color valance of an image displayed by the display device.

Color Allocation Example 3

Allocation in Checkered Pattern

Figure 11:
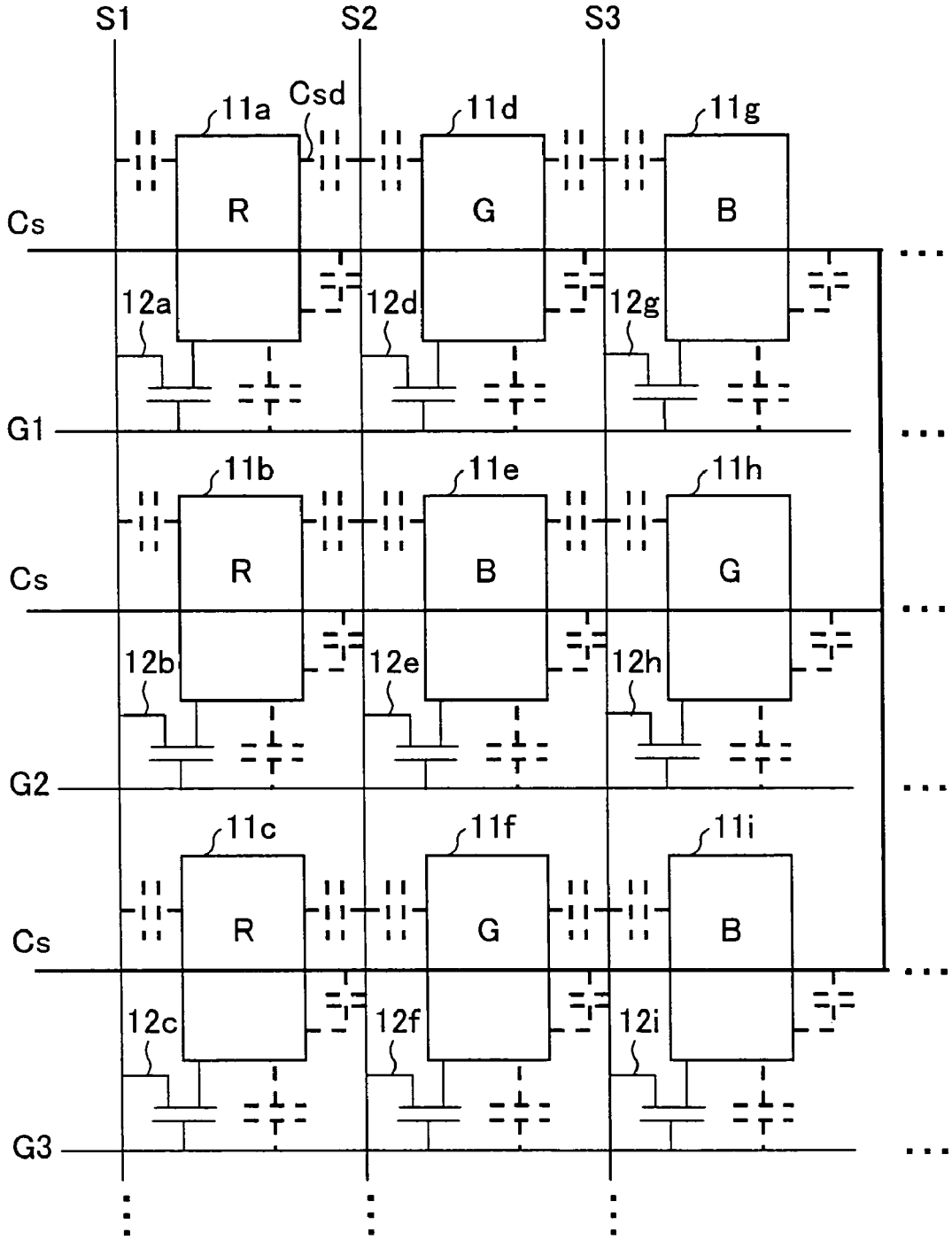
FIG. 11 is a plan view illustrating the display panel of FIG. 1 in the case where colors are allocated according to color allocation example 2.

In explaining color allocation example 3, it is necessary to set first, second, and third display pixel columns, each of which includes three display pixels. The display pixel columns may be set as in color allocation example 1. For example, as shown in FIG. 11, the display pixel columns may be set so that the display pixels 11*a*, 11*b*, and 11*c* are set as display pixels of the first display pixel column, the display pixels 11*d*, 11*e*, and 11*f* are set as display pixels of the second display pixel column, and the display pixels 11*g*, 11*h*, and 11*i* are set as display pixels of the third display pixel column.

In color allocation example 3, the display pixels of the second display pixel column and the display pixels of the third display pixel column are set so that R, G, and B, except the color displayed by the first display pixel column, are displayed to form a checkered pattern. For example, as shown in FIG. 11, if the display pixels 11*a*, 11*b*, and 11*c*, which are included in the first display column, are set to display R, then the display pixels 11*d* and 11*f* of the second display pixel column and the display pixel 11*h* of the third display pixel column are set to display G, and the display pixel 11*e* of the second display pixel column and the display pixels 11*g* and 11*i* of the third display pixel column are set to display B. In this color allocation, B and G may be replaced with one another.

The foregoing arrangement has the following advantage. Due to the influence of the voltage inputted to the source line S2, such crosstalk that has significant influence on the user's vision could occurs between the display pixel 11*a* and the display pixel 11*d*.

However, according to the foregoing arrangement, the plurality of display pixels of the first display pixel column are set so as to display one of R, G, and B. Therefore, even if such crosstalk that has significant influence on the user's vision occurs as described above, it is possible to distribute the crosstalk appropriately within the first display pixel column.

In addition, display colors of the plurality of display pixels of the second display pixel column and the plurality of display pixels of the third display pixel column are set so that two of R, G, and B form a checkered pattern. Thus, in the second display pixel column and in the third display pixel column, colors are allocated evenly to the display pixels, without deteriorating the color balance.

In this way, it is possible to distribute the crosstalk occurring in the second display pixel column and in the third display pixel column at right balance within the respective pixel columns. As a result, it is possible to correct the color valance of an image displayed by the display device. Alternatively, the second column or the third column may be one color, and the other two columns may form a checkered pattern.

Color Allocation Example 4

Four-Color Allocation

In color allocation example 4, four colors (first display color to fourth display color) are allocated to the display pixels. The four colors are R, G, B, and white, or cyan, magenta, yellow, and green, for example. Basic allocation method is the same as the method used in color allocation examples 1 to 3.

In the case of allocating four colors according to color allocation example 1, a fourth display pixel column is provided as follows. The fourth display pixel column is a column including a plurality of display pixels connected, through a switching element, to a fourth source line, which is adjacent to the third source line on the side opposite the second source line. The plurality of display pixels are set to display a color that is not displayed by the first to third display pixel columns, among the first to fourth colors.

For example, if the display panel 7 is arranged as shown in FIG. 8, the plurality of pixels connected, through a switching element, to the source line (not shown) that is adjacent to the source line S3 on the side opposite the source line S2 is set as the fourth display pixel column. Then, the fourth display pixel column is set to display white.

In the case of allocating the four colors according to color allocation example 2, it is necessary to set the first display pixel group and the second display pixel group as follows. As shown in FIG. 9, the four display pixels of the first display pixel group are respectively set as a third display pixel, a fourth display pixel, the first display pixel, and the second display pixel. The third display pixel is driven by the first gate line, and connected, through a switching element, to the source line that is connected to the second display pixel through a parasitic capacitance only. The fourth display pixel is driven by the first gate line, and connected, through a switching element, to the source line that is connected to the third display pixel through a parasitic capacitance only. For example, as shown in FIG. 9, if the display pixel 11*a* is set as the first display pixel and the display pixel 11*d* is set as the second display pixel, the display pixel 11*g* is set as the third display pixel. The display pixel 11*g* is a pixel driven by the gate line (first gate line) G1 and connected, through the switching element 12*g*, to the source line S3, which is connected to the display pixel 11*d* through a parasitic capacitance Csd. Likewise, a display pixel 11*j* is set as the fourth display pixel. The display pixel 11*j* is a pixel driven by the gate line G1 and connected, through a switching element 12*j*, to a source line S4, which is connected to the display pixel 11*g* through a parasitic capacitance Csd.

The display pixels 11*a*, 11*d*, 11*g*, and 11*j* are set to display R, G, B, and white so that display colors of these display pixels are different from each other. For example, as shown in FIG. 9, the display pixel 11*a* is set to display R, the display pixel 11*d* is set to display G, the display pixel 11*g* is set to display B, and the display pixel 11*j* is set to display white.

Meanwhile, the four display pixels of the second display pixel group are respectively set as fifth, sixth, seventh, and eighth display pixels. The fifth display pixel is connected, through a switching element, to (i) the source line connected to the first display pixel through a switching element and (ii) the second gate line, which is adjacent to the first gate line. The sixth display pixel is connected, through a switching element, to (i) the source line connected to the second display pixel through a switching element and (ii) the second gate line. The seventh display pixel is connected, through a switching element, to (i) the source line connected to the third display pixel through a switching element and (ii) the second gate line. The eighth display pixel is connected, through a switching element, to (i) the source line connected to the fourth display pixel through a switching element and (ii) the second gate line. For example, if the display pixel 11*a* is set as the first display pixel as described above, the display pixel 11*b* is set as the fifth display pixel. The display pixel 11*b* is connected, through the switching element 12*a*, to (i) the source line S1, which is connected to the display pixel 11*a* through the switching element 12*a* and (ii) the gate line (second gate line) G2, which is adjacent to the gate line G1. Likewise, the display pixel 11*e* is set as the sixth display pixel, the display pixel 11*h* is set as the seventh display pixel, and the display pixel 11*k* is set as the eighth display pixel.

The fifth display pixel is set to display the color displayed by the fourth display pixel; the sixth display pixel is set to display the color displayed by the first display pixel; the seventh display pixel is set to display the color displayed by the second display pixel; and the eighth display pixel is set to display the color displayed by the third display pixel. Specifically, as shown in FIG. 9, the display pixel 11*b* is set to display white, the display pixel 11*e* is set to display R, the display pixel 11*h* is set to display G, and the display pixel 11*k* is set to display B.

Alternatively, the colors may be allocated so that the fifth display pixel displays the color displayed by the second display pixel, the sixth display pixel displays the color displayed by the third display pixel, the seventh display pixel displays the color displayed by the fourth display pixel, and the eighth display pixel displays the color displayed by the first display pixel. Specifically, as shown in FIG. 10, the display pixel 11*b* is set to G, the display pixel 11*e* is set to B, the display pixel 11*h* is set to white, and the display pixel 11*k* is set to R.

In the case where the four colors are allocated according to color allocation example 3, the fourth display pixel column is provided as follows. Specifically, the plurality of display pixels connected, through respective switching elements, to the fourth source line, which is adjacent to the third source line on the side opposite the second source line, are set as the fourth display pixel column.

The display colors of the display pixels of the second, third, and fourth display pixel columns are set so that three colors (the first, second, third, and fourth display colors except the color displayed by the first display pixel column) form a checkered pattern.

For example, if the display panel 7 is arranged as shown in FIG. 11, the plurality of display pixels connected, through respective switching elements, to the source line (not shown) that is adjacent to the source line S3 on the side opposite the source line S2 are set as the fourth display pixel column.

The display colors of the display pixels of the second, third, and fourth display pixel columns are set so that three colors (the first, second, third, and fourth display colors except the color displayed by the first display pixel column) form a checkered pattern.

For example, as shown in FIG. 11, if the display pixels 11*a*, 11*b*, and 11*c*, which are included in the first display pixel column, are set to display R, then the display colors of the display pixels 11*d* to 11*f* (included in the second display pixel column), the display pixels 11*g* to 11*i* (included in the third display pixel column), and the display pixels of the fourth display pixel column (not shown) are set so that G, B, and white form a checkered pattern.

Specifically, allocating three colors in a checkered pattern means that allocation is performed by a procedure substantially identical to the procedure of color allocation example 2. For example, in order to allocate the three colors R, G, and B in a checkered pattern, the display colors of the display pixels of the second to fourth display pixel columns are set like the display pixels 11*a* to 11*i* shown in FIG. 9 or FIG. 10. That is, display colors of adjacent display picture elements, which have a gate line therebetween, are arranged in different orders after each crossing with a gate line, in the following manner: RGB, BRG, GBR, . . . (see FIG. 9). Alternatively, display colors of adjacent display picture elements are arranged in different orders after each crossing with a gate line, in the following manner: RGB, GBR, BRG, . . . (see FIG. 10).

Thus, four colors may be allocated to a plurality of display pixels by a method substantially identical to the methods of color allocation examples 1 to 3. The effects of color allocation examples 1 to 3 can be attained also by allocating four colors as described above.

4. HOW TO CONNECT SOURCE LINES AND DISPLAY PIXELS

The following provides two examples of how to connect the source lines and the display pixels in order to reduce the crosstalk efficiently by the driving method of the present invention. The following connection examples 1 and 2 are applicable to any of color allocation examples 1 to 4.

Connection Example 1

L-Shaped Portion

Figure 12:
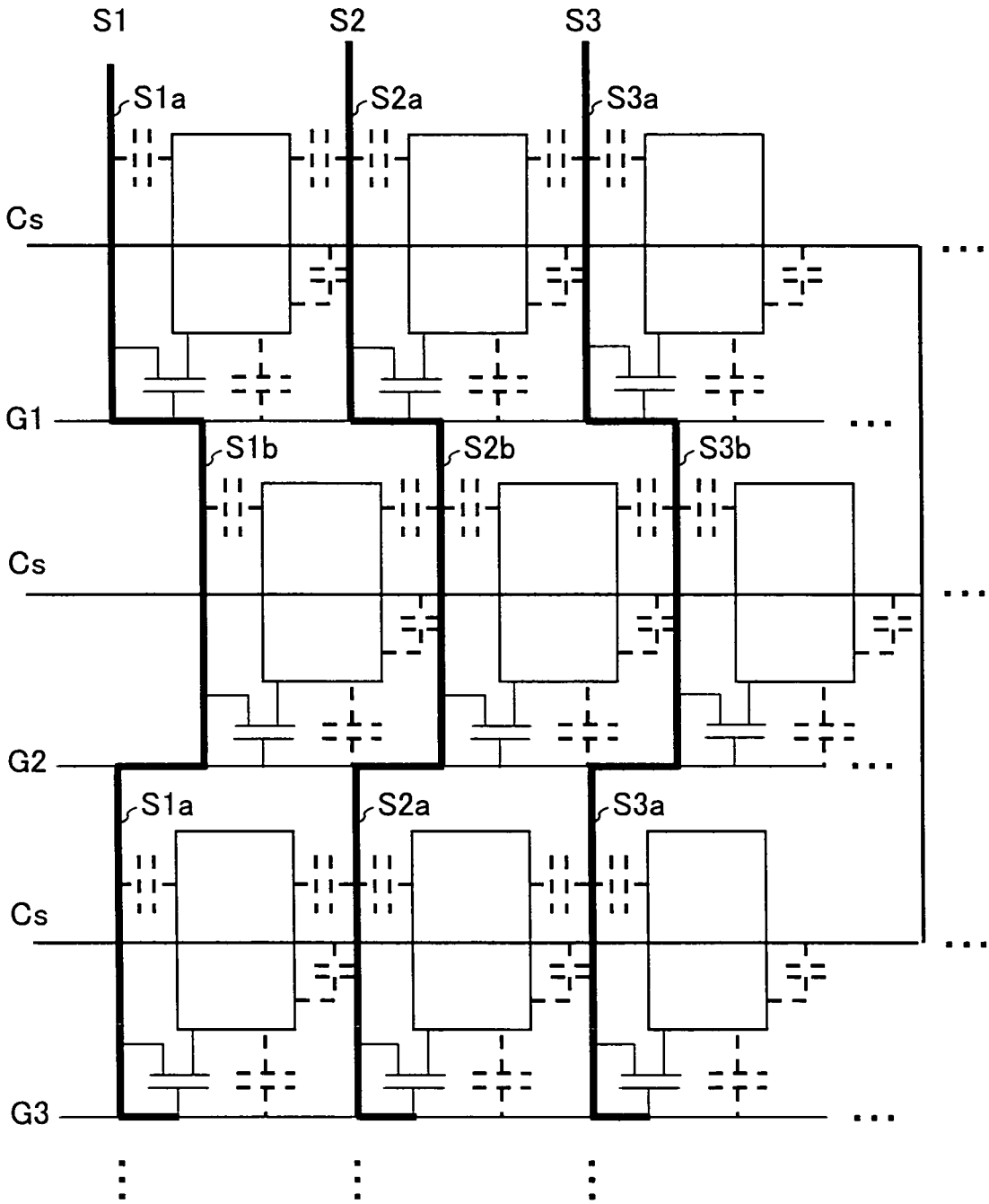
FIG. 12 is a plan view illustrating the display panel of FIG. 1 in which source lines and display pixels are connected according to connection example 1.

In connection example 1, each of the plurality of source lines is alternately provided with an L-shaped portion and a reverse-L-shaped portion. Specifically, as shown in FIG. 12, the source line S1 is alternately provided with an L-shaped portion S1*a* and a reverse-L-shaped portion S1*b*. Likewise, the source line S2 is alternately provided with an L-shaped portion S2*a* and a reverse-L-shaped portion S2*b*, and the source line S3 is alternately provided with an L-shaped portion S3*a* and a reverse-L-shaped portion S3*b*.

In FIG. 12, a display pixel connected to a reverse-L-shaped portion S1*b* is adjacent to a longer portion of the source line S2 than a display pixel connected to an L-shaped portion S1*a*. Therefore, a higher parasitic capacitance is formed between the source line S2 and the display pixel connected to the reverse-L-shaped portion S1*b*. In view of the circumstance, by allocating G and B in a checkered pattern to the plurality of display pixels connected to the gate line S2 and to the gate line S3, it is possible to concentrate the crosstalk to B, which has low visibility. In this way, it is possible to correct the color balance of the display panel.

Connection Example 2

Alternating Directions of Connection Every Time Source Line Crosses Gate Line

Figure 13:
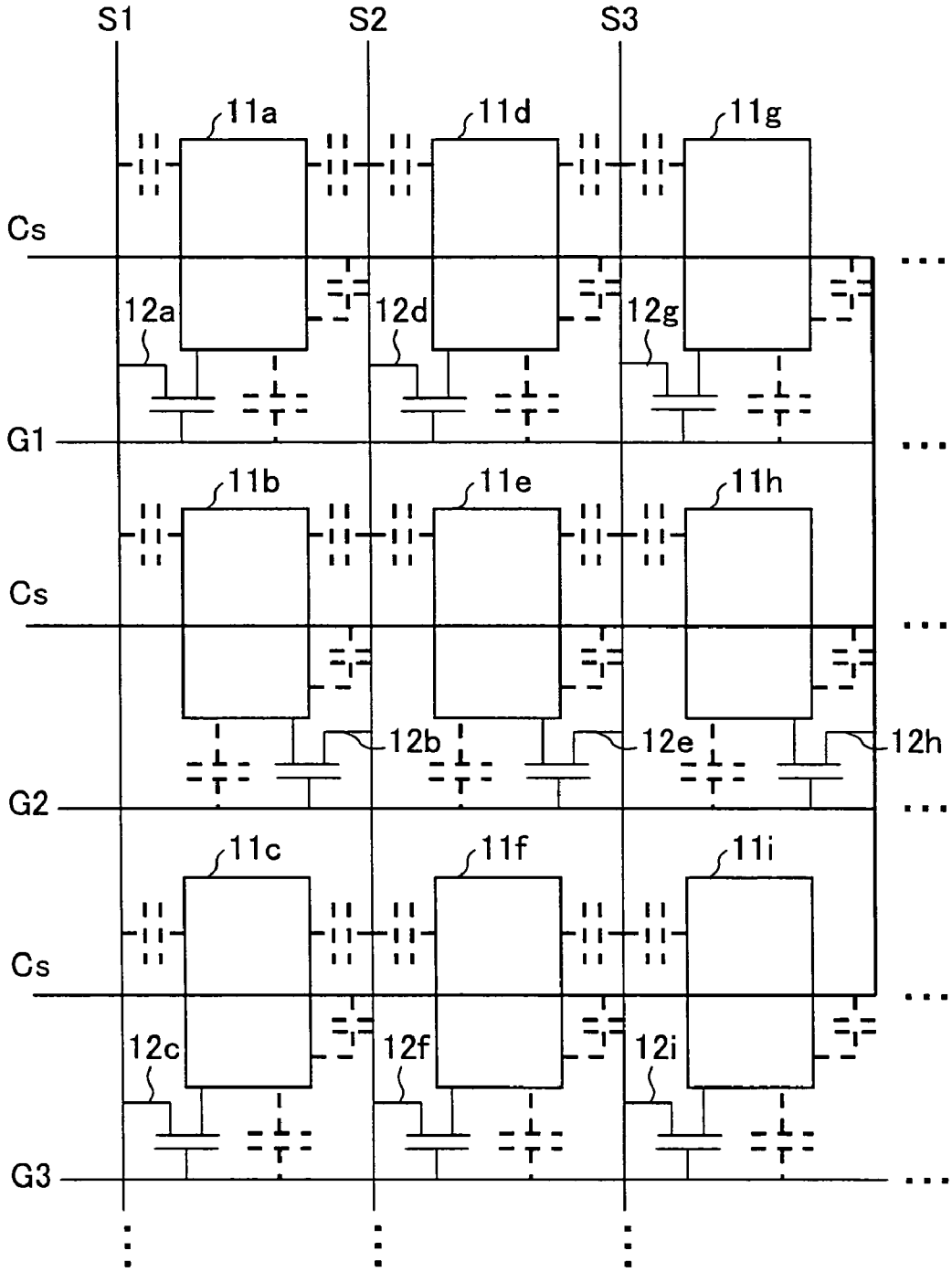
FIG. 13 is a plan view illustrating the display panel of FIG. 1 in which source lines and display pixels are connected according to connection example 1.

In connection example 2, the positions of switching elements relative to a corresponding source line is alternated after every crossing of the source line with a gate line. Specifically, as shown in FIG. 13, the source line S2 is connected to the switching elements 12*d* and 12*b*. While the switching element 12*d* is connected to the display pixel 11*d*, which is on the right of the source line S2, the switching element 12*b* is connected to the display pixel 11*b*, which is on the left of the source line S2.

Likewise, the source lines S1, S3, . . . are arranged so that the positions of the switching elements relative to a corresponding source line are alternated between right and left after each crossing of the source line with the gate lines G1, G2, G3, . . .

According to connection example 1 and connection example 2, there is the following advantage. Crosstalk occurs between a parasitic capacitance and a display pixel, that is, between a source line and a display pixel. Therefore, if the source lines are provided in parallel with each other, crosstalk occurs at linearly located positions along the source lines, thereby deteriorating the color balance.

However, according to the foregoing arrangement, each source line is alternately provided with an L-shaped portion and a reverse-L-shaped portion. As a result, the parasitic capacitance formed between a display pixel and a source line is distributed. In this way, the crosstalk can be distributed appropriately within the display device. Therefore, it is possible to correct the color balance of an image displayed by the display device.

5. PROGRAM

In the foregoing description, the CCT correction circuit 2 (color saturation emphasizing circuit 10) is realized by hardware only. However, the CCT correction circuit 2 or the color saturation emphasizing circuit 10 may be realized, entirely or partially, by a combination of (i) a program for realizing the foregoing functions and (ii) hardware (computer) for executing the program. For example, the CCT correction circuit 2 or the color saturation emphasizing circuit 10 may be realized by a computer connected to the color display device 1, as a device driver for driving the display panel 7. If (i) the CCT correction circuit 2 or the color saturation emphasizing circuit 10 is realized as a conversion substrate externally provided to the color display device 1, and (ii) operation of a circuit that realizes the CCT correction circuit 2 or the color saturation emphasizing circuit 10 can be changed by rewriting a program such as software, the circuit may be caused to function as the CCT correction circuit 2 (color saturation emphasizing circuit 10) by distributing the software and thereby changing the operation of the circuit.

In these cases, if hardware that can realize the foregoing functions is provided, the CCT correction circuit 2 (color saturation emphasizing circuit 10) of the foregoing embodiment can be realized by simply causing the hardware to execute the program.

In the present invention, a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal for the first display pixel is obtained by correcting an input signal for the first display pixel in accordance with an input signal for the second display pixel or a write signal for the second display pixel.

By thus considering, in determining the write signal for the first display pixel, the influence of the parasitic capacitance between the pixel electrode of the first display pixel and the source line that drives the second display pixel, it is possible to drastically reduce a gap between a display gradation and a desired gradation (amount of crosstalk) caused by the parasitic capacitance, which fluctuates the potential of the pixel electrode (each pixel electrode) of the first display pixel. As a result, it is possible to improve display quality (correct color balance).

In the foregoing method, it is preferable that a write signal gradation for the first display pixel is a sum of an input signal gradation for the first display pixel and a correction gradation F(g) represented by $$F(g)=Csd\cdot(Ugad-Ubad)/Cp\cdot(U(g+1)-U(g))$$

where Cp is a capacitance value of the first display pixel, Csd is a capacitance value of the parasitic capacitance formed between the source line connected to the second display pixel and the pixel electrode of the first display pixel, U(g) is an input signal voltage for the first display pixel when a level of an input signal gradation for the first display pixel is g, Ugad is an input signal voltage or a write signal voltage for the second display pixel, and Ubad is a voltage to be applied to a common electrode, which is opposed to each display pixel.

Alternatively, the foregoing method may be such that, if an effective voltage Va is required in order to display a desired gradation by the first display pixel, a write signal voltage for the first display pixel is a voltage V(A) represented by $$V(A)=(Cp\times Va-Cgd\times Vg-Csdb\times V(B)+Ccs\times Vc)/(Cp+Csda)$$

where V(B) is an input signal voltage or a write signal voltage for the second display pixel, Csda is a capacitance value of a parasitic capacitance formed between the source line connected to the first display pixel and the pixel electrode of the first display pixel, Csdb is a capacitance value of the parasitic capacitance formed between the source line connected to the second display pixel and the pixel electrode of the first display pixel, Cgd is a capacitance value of a parasitic capacitance formed between the gate line connected to the first display pixel and the pixel electrode of the first display pixel, Ccs is a capacitance value of a parasitic capacitance formed between a storage capacitor electrode, which is provided so as to correspond to the first display pixel, and a drain electrode of the switching element of the first display pixel, Vg is a voltage to be applied to the first gate line, Vc is a voltage to be applied to the storage capacitor electrode, and Cp is a capacitance value of the first display pixel.

A method of the present invention for driving a display device is a method of driving a display device including display pixels each of which includes a switching element and a pixel electrode, each of the display pixels being provided at each intersection of a plurality of gate lines and a plurality of source lines, wherein: a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values.

According to the foregoing arrangement, the write signal voltage for the first display pixel is obtained by correcting the input signal voltage for the first display pixel in accordance with the input signal voltage for the second display pixel or the write signal voltage for the second display pixel. By thus considering, in determining the write signal for the first display pixel, the influence of the parasitic capacitance between the pixel electrode of the first display pixel and the source line that drives the second display pixel, it is possible to drastically reduce a gap between a display gradation and a desired gradation (amount of crosstalk) caused by the parasitic capacitance, which fluctuates the potential of the pixel electrode (each pixel electrode) of the first display pixel. As a result, it is possible to improve display quality (correct color balance).

Analog data representing a signal voltage does not linearly respond to digital data representing a gradation level. Therefore, a large number of bits are required in order to process the analog data. Thus, the process of correcting the signal gradation for the first display pixel by using digital data (i.e. gradation level) is simpler than the process of correcting the signal voltage for the first display pixel by using analog data (i.e. signal voltage data itself).

Therefore, according to the foregoing arrangement, it is possible to correct the color balance of the display device by a simple process.

Further, in the method of the foregoing arrangement, it is preferable that, if LA is lower than a predetermined threshold value, F(LA, LB) is defined as $$F(LA, LB)=k(LA-LB), \text{ where } k>0; \text{ and}$$

if LA is higher than the threshold value, F(LA, LB) is defined as a function that outputs a constant value.

The value of the correction value F(LA, LB), which is to be added to LA in order to reduce the crosstalk, shows a monotone increase in accordance with the value of LA, until LA reaches a predetermined threshold value. If the value of LA is higher than the threshold value, there is no longer clear correlation between LA and F(LA, LB), and the error rate of the stimulus value is low. In this case, the crosstalk can be reduced by relatively rough correction, such as adding a constant value to LA and outputs Lout.

Thus, by defining F(LA, LB) as described above, there is an additional effect that Lout can be calculated by a simple process.

Further, in the method of the foregoing arrangement, it is preferable that a plurality of integers are extracted from within a range of zero to a maximum gradation level, and values of F(LA, 0), where LA is the plurality of integers, are associated with values of LA and stored in a look-up table; and a value of F(LA, LB), where LA is a value not stored in the look-up table, is interpolated in accordance with a value of LA stored in the look-up table, a value of F(LA, 0) associated with the value of LA, and values of LA and LB that satisfy F(LA, LB)=0.

According to this arrangement, the value of F(LA, LB) can be determined by using a look-up table. Therefore, by creating the look-up table in advance with respect to each kind of display device, it is possible to determine an appropriate value of F(LA, LB) in accordance with the kind of the display device.

As a result, there is an additional effect that it is possible to reduce the crosstalk and thereby correct the color balance, regardless of the kind of the display device.

In the method of the foregoing arrangement, it is preferable that, if LA>LB, the value of F(LA, LB) is interpolated by linear interpolation.

The interpolation by linear line is the simplest interpolation method. Therefore, according to the foregoing arrangement, there is an additional effect that it is possible to determine, by a simple process, an appropriate value of F(LA, LB) in accordance with the kind of the display device.

Further, in the method of the foregoing arrangement, it is preferable that, if LA<LB, F(LA, LB) is defined as F(LA, LB)=0.

If LA<LB, the gradation level of the display pixel (A) is low. In this case, even if crosstalk is caused between a source line and the first display pixel, the influence of the crosstalk on the display pixel (A) is small. Therefore, if LA<LB, it is not necessary to determine the correction value F(LA, LB).

Therefore, according to the foregoing arrangement, it is possible to reduce the crosstalk by a simpler process.

Further, the present invention may be a method of driving a display device including display pixels each of which includes a switching element and a pixel electrode, each of the display pixels being provided at each intersection of a plurality of gate lines and a plurality of source lines, wherein: first, second, and third display pixels, which are for respectively displaying first, second, and third display colors, are connected to the same gate line, the second display pixel is connected to a source line that is adjacent to a source line connected to the first display pixel and that forms a parasitic capacitance with the pixel electrode of the first display pixel, and the third display pixel is connected to a source line that is adjacent to the source line connected to the second display pixel and that forms a parasitic capacitance with the pixel electrode of the second display pixel; and a write signal gradation for the first display pixel is a sum of an input signal gradation LA for the first display pixel and a correction gradation G(LA, LB, and LC) represented by $$G(LA, LB, LC)=k_{LB}(LA-LB)+k_{LC}(LA-LC)$$

where LA is the input signal gradation of the first display pixel, LB is an input signal gradation or a write signal gradation for the second display pixel, LC is an input signal gradation or a write signal gradation for the third display pixel, $k_{LB}$ is a function of LB, $k_{LC}$ is a function of LC, and there exists such p, which satisfies 0<p<255, that k(0)=certain constant value, k(MAX)=0, and k(p)=local maximum value, where MAX is a maximum value of a gradation level displayed.

The method of the foregoing arrangement may be arranged so that the first display color is R, the second display color is G, and the third display color is B.

According to this arrangement, the crosstalk can be reduced by a conventional color saturation emphasizing process. Therefore, by causing a computer, which is provided inside or outside the display device, to execute a program for executing the conventional color saturation emphasizing process, it is possible to reduce the crosstalk at low cost.

Further, in the method of the foregoing arrangement, it is preferable that the plurality of source lines are provided in parallel with each other; and an image is displayed by a display picture element, which includes display pixels for respectively displaying first, second, and third display colors, the display device including the following first, second, and third display pixel columns.

The first display pixel column is a plurality of display pixels connected, respectively through switching elements, to a first source line, which is connected to the first display pixel through a switching element, the first display pixel column being adapted to display one of the first, second, or third display colors.

The second display pixel column is a plurality of display pixels connected, respectively through switching elements, to a second source line, which is connected to the second display pixel through a switching element, the second display pixel column being adapted to display one of the first, second, or third display colors that is not displayed by the first display pixel column.

The third display pixel column is a plurality of display pixels connected, respectively through switching elements, to a third source line, which is adjacent to the second source line on a side opposite the first source line, the third display pixel column being adapted to display one of the first, second, or third display colors that is not displayed by the first display pixel column or the second display pixel column.

The method of providing the first to third display pixel columns and allocating the first to third display colors thereto as described above is commonly adopted as a method of allocating colors to a plurality of display pixels of a display device. Therefore, according to the foregoing arrangement, it is possible to lower the level of the crosstalk caused in a generally used display device, and thereby correct the color balance of an image displayed by the display device.

Further, in the display device of the foregoing arrangement, the display picture element may further includes a display pixel for displaying a fourth display color, the display device further including a fourth display pixel column, which is a plurality of display pixels connected, respectively through switching elements, to a fourth source line, which is adjacent to the third source line on a side opposite the second source line, the fourth display pixel column being adapted to display the fourth display color.

Further, the display device of the foregoing arrangement may be such that the plurality of source lines are provided in parallel with each other; and an image is displayed by a display picture element, which includes display pixels for respectively displaying first, second, and third display colors, the display device including a first display pixel group including three display pixels, and a second display pixel group including another three display pixels.

The three display pixels of the first display pixel group are the first display pixel, the second display pixel, and a third display pixel, which is driven by the first gate line and connected, through a switching element, to a source line connected to the second display pixel through a parasitic capacitance. Each of the first, second, and third display pixels is adapted to display one of the first, second, or third display colors, and display colors of the first, second, and third display pixels are different from each other.

The three display pixels of the second display pixel group are fourth, fifth, and sixth display pixels.

The fourth display pixel is connected to (i) a source line connected to the first display pixel through a switching element and (ii) a second gate line through a switching element, the second gate line being adjacent to the first gate line.

The fifth display pixel is connected to (iii) the source line connected to the second display pixel through a switching element and (iv) the second gate line through a switching element.

The sixth display pixel is connected to (v) a source line connected to the third display pixel through a switching element and (vi) the second gate line through a switching element.

The fourth display pixel is adapted to display the display color of the third display pixel, the fifth display pixel is adapted to display the display color of the first display pixel, and the sixth display pixel is adapted to display the display color of the second display pixel. Alternatively, the fourth display pixel is adapted to display the display color of the second display pixel, the fifth display pixel is adapted to display the display color of the third display pixel, and the sixth display pixel is adapted to display the display color of the first display pixel.

According to the foregoing arrangement, the following additional effect can be expected. If such crosstalk that has significant influence on the user's vision occurs between the second display pixel and the first display pixel, the crosstalk could occur between other two display pixels.

However, according to the foregoing arrangement, the first to third display colors of the three display pixels driven by the same source line are set in different orders in the first display pixel group and in the second display pixel group. Thus, display colors are allocated to the display pixels evenly, without deteriorating the color balance of the color display device as a whole.

Therefore, even if such crosstalk that has significant influence on the user's vision occurs between two pixels other than the first and second display pixels, it is possible to distribute the crosstalk at right balance within the color display device. In this way, it is possible to lower the crosstalk level of the color display device as a whole, and thereby correct the color valance of an image displayed by the display device.

Further, the display device of the foregoing arrangement may be such that the plurality of source lines are provided in parallel with each other; and an image is displayed by a display picture element, which includes display pixels for respectively displaying first, second, third, and fourth display colors, the display device including a first display pixel group including four display pixels, and a second display pixel group including another four display pixels.

The four display pixels of the first display pixel group are the first display pixel, the second display pixel, a third display pixel, and a fourth display pixel, The third display pixel is driven by the first gate line, and connected, through a switching element, to a source line connected to the second display pixel through a parasitic capacitance only.

The fourth display pixel being driven by the first gate line, and connected, through a switching element, to a source line connected to the third display pixel through a parasitic capacitance only.

Each of the first, second, third, and fourth display pixels is adapted to display one of the first, second, third, or fourth display color, and display colors of the first, second, third, and fourth display pixels are different from each other.

The four display pixels of the second display pixel group are fifth, sixth, seventh, and eighth display pixels.

The fifth display pixel is connected to (i) a source line connected to the first display pixel through a switching element and (ii) a second gate line through a switching element, the second gate line being adjacent to the first gate line.

The sixth display pixel is connected to (iii) the source line connected to the second display pixel through a switching element and (iv) the second gate line through a switching element.

The seventh display pixel is connected to (v) a source line connected to the third display pixel through a switching element and (vi) the second gate line through a switching element.

The eighth display pixel is connected to (vii) a source line connected to the fourth display pixel through a switching element and (viii) the second source line through a switching element.

The fifth display pixel is adapted to display the display color of the fourth display pixel, the sixth display pixel is adapted to display the display color of the first display pixel, the seventh display pixel is adapted to display the display color of the second display pixel, and the eighth display pixel is adapted to display the display color of the third display pixel. Alternatively, the fifth display pixel is adapted to display the display color of the second display pixel, the sixth display pixel is adapted to display the display color of the third display pixel, the seventh display pixel is adapted to display the display color of the fourth display pixel, and the eighth display pixel is adapted to display the display color of the first display pixel.

According to the foregoing arrangement, the following additional effect can be expected. If such crosstalk that has significant influence on the user's vision occurs between the second display pixel and the first display pixel, the crosstalk could occur between other two display pixels.

However, according to the foregoing arrangement, the first to fourth display colors of the four display pixels driven by the same source line are set in different orders in the first display pixel group and in the second display pixel group. Thus, display colors are allocated to the display pixels evenly, without deteriorating the color balance of the color display device as a whole.

Therefore, even if such crosstalk that has significant influence on the user's vision occurs between two pixels other than the first and second display pixels, it is possible to distribute the crosstalk at right balance within the color display device. In this way, it is possible to lower the crosstalk level of the color display device as a whole, and thereby correct the color valance of an image displayed by the display device.

The display device of the present invention may be such that the plurality of source lines are provided in parallel with each other; and an image is displayed by a display picture element, which includes display pixels for respectively displaying first, second, and third display colors, the display device including first, second, and third display pixel columns.

The first display pixel column is a plurality of display pixels connected, respectively through switching elements, to a first source line, which is connected to the first display pixel through a switching element, the first display pixel column being adapted to display one of the first, second, or third display colors.

The second display pixel column is a plurality of display pixels connected to a second source line respectively through switching elements, the second source line being connected to the second display pixel through a switching element.

The third display pixel column is a plurality of display pixels connected to a third source line respectively through switching elements, the third source line being adjacent to the second source line on a side opposite the first source line.

The display pixels of the second display pixel column and the third display pixel column are adapted to form a checkered pattern by displaying two of the first, second, and third display colors that are not the display color of the first display pixel column.

According to this arrangement, for example, such crosstalk that has significant influence on the user's vision could occur between the second display pixel and the first display pixel, due to the influence of the voltage inputted to the second source line.

However, in the present invention, the plurality of display pixels of the first display pixel column are set to display one of the first to third display colors. Therefore, even if such crosstalk that has significant influence on the user's vision occurs, it is possible to distribute the crosstalk at right balance within the first display pixel column.

Further, the plurality of display pixels of the second and third display pixel columns are set so that two of the first to third display pixel columns form a checkered pattern. That is, in the second and third display pixel columns, colors are allocated to the display pixels evenly, without deteriorating the color balance.

Therefore, even if crosstalk occurs in the second and third display pixel columns, it is possible to distribute the crosstalk at right balance within the second and third display pixel columns. As a result, there is an additional effect that it is possible to further correct the color balance of an image displayed by the display device.

Further, the display device of the foregoing arrangement may be such that the display picture element further includes a display pixel for displaying a fourth display color, and the display device further includes a fourth display pixel column.

The fourth display pixel column is a plurality of display pixels connected to a fourth source line, the fourth source line being adjacent to the third source line on a side opposite the second source line. The display pixels of the second, third, and fourth display pixel columns are adapted to form a checkered pattern by displaying three of the first, second, third, and fourth display colors that are not the display color of the first display pixel column.

The display device of the foregoing arrangement may be such that the first display color is R, the second display color is G, and the third display color is B, or that the first display color is cyan, the second display color is magenta, and the third display color is yellow. Moreover, the fourth display color may be white or green.

Further, in the display device of the foregoing arrangement, it is preferable that each of the plurality of source lines are alternately provided with an L-shaped portion and a reverse-L-shaped portion. Alternatively, it is preferable that positions of switching elements relative to a corresponding source line are alternated after every crossing of the source line with a gate line.

As described above, crosstalk occurs between a parasitic capacitance and a display pixel, that is, between a source line and a display pixel. Therefore, if the source lines are provided in parallel with each other, crosstalk occurs at linearly located positions along the source lines, thereby deteriorating the color balance.

However, according to the foregoing arrangement, each source line is alternately provided with an L-shaped portion and a reverse-L-shaped portion, or positions of switching elements relative to a corresponding source line are alternated after every crossing of the source line with a gate line. In this way, the crosstalk can be distributed appropriately within the display device. Therefore, it is possible to further correct the color balance of an image displayed by the display device.

A program of the present invention is a program for causing a computer to execute the foregoing method. By causing a computer to execute the program, the effect of the method of the present invention can be attained.

A method of the present invention for driving a display device may be a method of driving a display device including display pixels and switching elements each of which is provided at each intersection of a plurality of gate lines and a plurality of source lines, wherein: a voltage to be applied to a first display pixel is corrected in accordance with a voltage to be applied to a second display pixel; the second display pixel is driven by a first gate line, which drives the first display pixel; and a source line connected to the second display pixel through a switching element is a source line connected to the first display pixel through a parasitic capacitance.

In this case, a gradation F(g) outputted as a correction gradation for the first display pixel may be represented by $$F(g)=Csd\cdot(Ugad-Ubad)/Cp\cdot(U(g+1)-U(g))$$

where Cp is a capacitance value of the first display pixel, Csd is a capacitance value of the parasitic capacitance that connects the first display pixel and the source line connected to the switching element of the second display pixel, U(g) is a voltage to be applied to the first display pixel when a gradation level is g, Ugad is a voltage to be applied to the second display pixel, and Ubad is a voltage to be applied to the first display pixel when black is to be displayed.

A voltage V(A) applied to the first display pixel may be represented by $$V(A)=(Cp\times Va-Cgd\times Vg-Csdb\times V(B)+Ccs\times Vc)/(Cp+Csda)$$

where Va is an effective value of a voltage to be applied to the first display pixel in order to display a desired gradation, V(B) is a voltage to be applied to the second display pixel, Csda is a capacitance value of a parasitic capacitance that connects the first display pixel and a source line connected to the first display pixel through a switching element, Csdb is a capacitance value of the parasitic capacitance that connects the first display pixel and the source line connected to the second display pixel through a switching element, Cgd is a capacitance value of a parasitic capacitance that connects the first display pixel and the first gate line, Ccs is a capacitance value of a parasitic capacitance that connects the first display pixel and a common electrode of the first display pixel, Vg is a voltage to be applied to the first gate line, Vc is a voltage to be applied to the common electrode, and Cp is a capacitance value of the first display pixel.

A method of the present invention for driving a display device may be a method of driving a display device including display pixels and switching elements each of which is provided at each intersection of a plurality of gate lines and a plurality of source lines, wherein: a voltage to be applied to a first display pixel is corrected in accordance with a voltage to be applied to a second display pixel, so that an input gradation level for the first display pixel is corrected to a gradation level Lout calculated by $$Lout=LA+F(LA, LB)$$

where LA is a gradation level to be inputted to the first display pixel, LB is a gradation level to be inputted to the second display pixel, and F(LA, LB) is a function using LA and LB as input values; the second display pixel is driven by a first gate line, which drives the first display pixel; and a source line connected to the second display pixel through a switching element is a source line connected to the first display pixel through a parasitic capacitance.

A display device of the present invention may be a display device including display pixels and switching elements each of which is provided at each intersection of a plurality of gate lines and a plurality of source lines, wherein: a voltage to be applied to a first display pixel is corrected in accordance with a voltage to be applied to a second display pixel; the second display pixel is driven by a first gate line, which drives the first display pixel; and a source line connected to the second display pixel through a switching element is a source line connected to the first display pixel through a parasitic capacitance.

The present invention can reduce crosstalk between two display pixels in a display device that drives display pixels by using a plurality of source lines and a plurality of gate lines. Thus, the present invention is suitable for improving color reproducibility of a display device, particularly a liquid crystal display device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a display device including display pixels each of which includes a switching element and a pixel electrode, each of the display pixels being provided at an intersection of one of a plurality of gate lines and one of a plurality of source lines, wherein:

a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal for the first display pixel is obtained by correcting an input signal for the first display pixel in accordance with an input signal for the second display pixel or a write signal for the second display pixel, wherein:

a write signal gradation for the first display pixel is a sum of an input signal gradation for the first display pixel and a correction gradation F(g) represented by $$F(g)=Csd\cdot(Ugad-Ubad)/Cp\cdot(U(g+1)-U(g))$$

where Cp is a capacitance value of the first display pixel, Csd is a capacitance value of the parasitic capacitance formed between the source line connected to the second display pixel and the pixel electrode of the first display pixel, U(g) is an input signal voltage for the first display pixel when a level of an input signal gradation for the first display pixel is g, Ugad is an input signal voltage or a write signal voltage for the second display pixel, and Ubad is a voltage to be applied to a common electrode, which is opposed to each display pixel.

2. A method of driving a display device including display pixels each of which includes a switching element and a pixel electrode, each of the display pixels being provided at an intersection of one of a plurality of gate lines and one of a plurality of source lines, wherein:

a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal for the first display pixel is obtained by correcting an input signal for the first display pixel in accordance with an input signal for the second display pixel or a write signal for the second display pixel, wherein:

if an effective voltage Va is required in order to display a desired gradation by the first display pixel, a write signal voltage for the first display pixel is a voltage V(A) represented by $$V(A)=(Cp\times Va-Cgd\times Vg-Csdb\times V(B)+Ccs\times Vc)/(Cp+Csda)$$

where V(B) is an input signal voltage or a write signal voltage for the second display pixel, Csda is a capacitance value of a parasitic capacitance formed between the source line connected to the first display pixel and the pixel electrode of the first display pixel, Csdb is a capacitance value of the parasitic capacitance formed between the source line connected to the second display pixel and the pixel electrode of the first display pixel, Cgd is a capacitance value of a parasitic capacitance formed between the gate line connected to the first display pixel and the pixel electrode of the first display pixel, Ccs is a capacitance value of a parasitic capacitance formed between a storage capacitor electrode, which is provided so as to correspond to the first display pixel, and a drain electrode of the switching element of the first display pixel, Vg is a voltage to be applied to the first gate line, Vc is a voltage to be applied to the storage capacitor electrode, and Cp is a capacitance value of the first display pixel.

3. A method of driving a display device including display pixels each of which includes a switching element and a pixel electrode, each of the display pixels being provided at an intersection of one of a plurality of gate lines and one of a plurality of source lines, wherein:

a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values, wherein:

if LA is lower than a predetermined threshold value, F(LA, LB) is defined as F(LA, LB)=k(LA−LB), where k>0; and if LA is higher than the threshold value, F(LA, LB) is defined as a function that outputs a constant value.

4. A method of driving a display device including display pixels each of which includes a switching element and a pixel electrode, each of the display pixels being provided at an intersection of one of a plurality of gate lines and one of a plurality of source lines, wherein:

a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values, wherein:

a plurality of integers are extracted from within a range of zero to a maximum gradation level, and values of F(LA, 0), where LA is the plurality of integers, are associated with values of LA and stored in a look-up table; and a value of F(LA, LB), where LA is a value not stored in the look-up table, is interpolated in accordance with a value of LA stored in the look-up table, a value of F(LA, 0) associated with the value of LA, and values of LA and LB that satisfy F(LA, LB)=0.

5. The method as set forth in claim 4, wherein:

if LA>LB, the value of F(LA, LB) is interpolated by linear interpolation.

6. A method of driving a display device including display pixels each of which includes a switching element and a pixel electrode, each of the display pixels being provided at an intersection of one of a plurality of gate lines and one of a plurality of source lines, wherein:

a first display pixel and a second display pixel are connected to the same gate line, and the second display pixel is connected to a source line that is adjacent to a source line connected to the first display pixel and that forms a parasitic capacitance with the pixel electrode of the first display pixel; and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values, wherein:

if LA<LB, F(LA, LB) is defined as F(LA, LB)=0.

7. A method of driving a display device including display pixels each of which includes a switching element and a pixel electrode, each of the display pixels being provided at an intersection of one of a plurality of gate lines and one of a plurality of source lines, wherein:

first, second, and third display pixels, which are for respectively displaying first, second, and third display colors, are connected to the same gate line, the second display pixel is connected to a source line that is adjacent to a source line connected to the first display pixel and that forms a parasitic capacitance with the pixel electrode of the first display pixel, and the third display pixel is connected to a source line that is adjacent to the source line connected to the second display pixel and that forms a parasitic capacitance with the pixel electrode of the second display pixel; and a write signal gradation for the first display pixel is a sum of an input signal gradation LA for the first display pixel and a correction gradation G(LA, LB, and LC) represented by $$G(LA, LB, LC)=k_{LB}(LA-LB)+k_{LC}(LA-LC)$$

where LA is the input signal gradation of the first display pixel, LB is an input signal gradation or a write signal gradation for the second display pixel, LC is an input signal gradation or a write signal gradation for the third display pixel, $k_{LB}$ is a function of $k_{LB}$ (p) of LB, $k_{LC}$ is a function of $k_{LC}$ (p) of LC, where p is a possible value of LB and LC, and there exists such p, which satisfies 0<p<255, that $k_{LB}(0)$=certain constant value, $k_{LC}(0)$=certain constant value, $k_{LB}(MAX)=0$, $k_{LC}(MAX)=0$, $k_{LB}(p)$=local maximum value, and $k_{LC}(p)$=local maximum value, where MAX is a maximum value of LB and LC.

8. The method as set forth in claim 7, wherein:

the first display color is R, the second display color is G, and the third display color is B.

9. A display device, comprising:

display pixels, each of which includes a switching element and a pixel electrode, each of the display pixels being provided at an intersection of one of a plurality of gate lines and one of a plurality of source lines, wherein a first display pixel and a second display pixel are connected to the same gate line, and the second display pixel is connected to a source line that is adjacent to a source line connected to the first display pixel and that forms a parasitic capacitance with the pixel electrode of the first display pixel, a write signal for the first display pixel is obtained by correcting an input signal for the first display pixel in accordance with an input signal for the second display pixel or a write signal for the second display pixel, and a write signal gradation for the first display pixel is a sum of an input signal gradation for the first display pixel and a correction gradation F(g) represented by $$F(g)=Csd\cdot(Ugad-Ubad)/Cp\cdot(U(g+1)-U(g))$$

where Cp is a capacitance value of the first display pixel, Csd is a capacitance value of the parasitic capacitance formed between the source line connected to the second display pixel and the pixel electrode of the first display pixel, U(g) is an input signal voltage for the first display pixel when a level of an input signal gradation for the first display pixel is g, Ugad is an input signal voltage or a write signal voltage for the second display pixel, and Ubad is a voltage to be applied to a common electrode, which is opposed to each display pixel.

10. The display device as set forth in claim 9, wherein:

each of the plurality of source lines is alternately provided with an L-shaped portion and a reverse-L-shaped portion.

11. The display device as set forth in claim 9, wherein:

positions of switching elements relative to a corresponding source line are alternated after every crossing of the source line with a gate line.

12. The display device as set forth in claim 9, wherein:

the plurality of source lines are provided in parallel with each other; and an image is displayed by a display picture element, which includes display pixels for respectively displaying first, second, and third display colors, the display device comprising first, second, and third display pixel columns, the first display pixel column being a plurality of display pixels connected, respectively through switching elements, to a first source line, which is connected to the first display pixel through a switching element, the first display pixel column being adapted to display one of the first, second, or third display colors, the second display pixel column being a plurality of display pixels connected, respectively through switching elements, to a second source line, which is connected to the second display pixel through a switching element, the second display pixel column being adapted to display one of the first, second, or third display colors that is not displayed by the first display pixel column, the third display pixel column being a plurality of display pixels connected, respectively through switching elements, to a third source line, which is adjacent to the second source line on a side opposite the first source line, the third display pixel column being adapted to display one of the first, second, or third display colors that is not displayed by the first display pixel column or the second display pixel column.

13. The display device as set forth in claim 12, wherein:

the display picture element further includes a display pixel for displaying a fourth display color, the display device further comprising a fourth display pixel column, which is a plurality of display pixels connected, respectively through switching elements, to a fourth source line, which is adjacent to the third source line on a side opposite the second source line, the fourth display pixel column being adapted to display the fourth display color.

14. The display device as set forth in claim 13, wherein:

the first display color is R, the second display color is G, the third display color is B, and the fourth display color is white.

15. The display device as set forth in claim 13, wherein:

the first display color is cyan, the second display color is magenta, the third display color is yellow, and the fourth display color is green.

16. The display device as set forth in claim 12, wherein:

the first display color is R, the second display color is G, and the third display color is B.

17. The display device as set forth in claim 12, wherein:

the first display color is cyan, the second display color is magenta, and the third display color is yellow.

18. The display device as set forth in claim 9, wherein:

the plurality of source lines are provided in parallel with each other; and an image is displayed by a display picture element, which includes display pixels for respectively displaying first, second, and third display colors, the display device comprising a first display pixel group including three display pixels, and a second display pixel group including another three display pixels, the three display pixels of the first display pixel group being the first display pixel, the second display pixel, and a third display pixel, which is driven by the first gate line and connected, through a switching element, to a source line connected to the second display pixel through a parasitic capacitance, each of the first, second, and third display pixels being adapted to display one of the first, second, or third display colors, and display colors of the first, second, and third display pixels being different from each other, the three display pixels of the second display pixel group being fourth, fifth, and sixth display pixels, the fourth display pixel being connected to (i) a source line connected to the first display pixel through a switching element and (ii) a second gate line through a switching element, the second gate line being adjacent to the first gate line, the fifth display pixel being connected to (iii) the source line connected to the second display pixel through a switching element and (iv) the second gate line through a switching element, the sixth display pixel being connected to (v) a source line connected to the third display pixel through a switching element and (vi) the second gate line through a switching element, the fourth display pixel being adapted to display the display color of the third display pixel, the fifth display pixel being adapted to display the display color of the first display pixel, and the sixth display pixel being adapted to display the display color of the second display pixel.

19. The display device as set forth in claim 18, wherein:

the first display color is R, the second display color is G, and the third display color is B.

20. The display device as set forth in claim 18, wherein:

the first display color is cyan, the second display color is magenta, and the third display color is yellow.

21. The display device as set forth in claim 9, wherein:

the plurality of source lines are provided in parallel with each other; and an image is displayed by a display picture element, which includes display pixels for respectively displaying first, second, third, and fourth display colors, the display device comprising a first display pixel group including four display pixels, and a second display pixel group including another four display pixels, the four display pixels of the first display pixel group being the first display pixel, the second display pixel, a third display pixel, and a fourth display pixel, the third display pixel being driven by the first gate line, and connected, through a switching element, to a source line connected to the second display pixel through a parasitic capacitance only, the fourth display pixel being driven by the first gate line, and connected, through a switching element, to a source line connected to the third display pixel through a parasitic capacitance only, each of the first, second, third, and fourth display pixels being adapted to display one of the first, second, third, or fourth display color, and display colors of the first, second, third, and fourth display pixels being different from each other, the four display pixels of the second display pixel group being fifth, sixth, seventh, and eighth display pixels, the fifth display pixel being connected to (i) a source line connected to the first display pixel through a switching element and (ii) a second gate line through a switching element, the second gate line being adjacent to the first gate line, the sixth display pixel being connected to (iii) the source line connected to the second display pixel through a switching element and (iv) the second gate line through a switching element, the seventh display pixel being connected to (v) a source line connected to the third display pixel through a switching element and (vi) the second gate line through a switching element, the eighth display pixel being connected to (vii) a source line connected to the fourth display pixel through a switching element and (viii) the second source line through a switching element, the fifth display pixel being adapted to display the display color of the fourth display pixel, the sixth display pixel being adapted to display the display color of the first display pixel, the seventh display pixel being adapted to display the display color of the second display pixel, and the eighth display pixel being adapted to display the display color of the third display pixel.

22. The display device set forth in claim 21, wherein:

the first display color is R, the second display color is G, and the third display color is B.

23. The display device as set forth in claim 21, wherein:

the first display color is cyan, the second display color is magenta, and the third display color is yellow.

24. The display device as set forth in claim 21, wherein:

the first display color is R, the second display color is G, the third display color is B, and the fourth display color is white.

25. The display device as set forth in claim 21, wherein:

the first display color is cyan, the second display color is magenta, the third display color is yellow, and the fourth display color is green.

26. The display device as set forth in claim 9, wherein:

the plurality of source lines are provided in parallel with each other; and an image is displayed by a display picture element, which includes display pixels for respectively displaying first, second, and third display colors, the display device comprising a first display pixel group including three display pixels, and a second display pixel group including another three display pixels, the three display pixels of the first display pixel group being the first display pixel, the second display pixel, and a third display pixel, which is driven by the first gate line and connected, through a switching element, to a source line connected to the second display pixel through a parasitic capacitance, each of the first, second, and third display pixels being adapted to display one of the first, second, or third display colors, and display colors of the first, second, and third display pixels being different from each other, the three display pixels of the second display pixel group being fourth, fifth, and sixth display pixels, the fourth display pixel being connected to (i) a source line connected to the first display pixel through a switching element and (ii) a second gate line through a switching element, the second gate line being adjacent to the first gate line, the fifth display pixel being connected to (iii) the source line connected to the second display pixel through a switching element and (iv) the second gate line through a switching element, the sixth display pixel being connected to (v) a source line connected to the third display pixel through a switching element and (vi) the second gate line through a switching element, the fourth display pixel being adapted to display the display color of the second display pixel, the fifth display pixel being adapted to display the display color of the third display pixel, and the sixth display pixel being adapted to display the display color of the first display pixel.

27. The display device as set forth in claim 26, wherein:

the first display color is R, the second display color is G, and the third display color is B.

28. The display device as set forth in claim 26, wherein:

the first display color is cyan, the second display color is magenta, and the third display color is yellow.

29. The display device as set forth in claim 9, wherein:

the plurality of source lines are provided in parallel with each other; and an image is displayed by a display picture element, which includes display pixels for respectively displaying first, second, third, and fourth display colors, the display device comprising a first display pixel group including four display pixels, and a second display pixel group including another four display pixels, the four display pixels of the first display pixel group being the first display pixel, the second display pixel, a third display pixel, and a fourth display pixel, the third display pixel being driven by the first gate line, and connected, through a switching element, to a source line connected to the second display pixel through a parasitic capacitance only, the fourth display pixel being driven by the first gate line, and connected, through a switching element, to a source line connected to the third display pixel through a parasitic capacitance only, each of the first, second, third, and fourth display pixels being adapted to display one of the first, second, third, or fourth display color, and display colors of the first, second, third, and fourth display pixels being different from each other, the four display pixels of the second display pixel group being fifth, sixth, seventh, and eighth display pixels, the fifth display pixel being connected to (i) a source line connected to the first display pixel through a switching element and (ii) a second gate line through a switching element, the second gate line being adjacent to the first gate line, the sixth display pixel being connected to (iii) the source line connected to the second display pixel through a switching element and (iv) the second gate line through a switching element, the seventh display pixel being connected to (v) a source line connected to the third display pixel through a switching element and (vi) the second gate line through a switching element, the eighth display pixel being connected to (vii) a source line connected to the fourth display pixel through a switching element and (viii) the second source line through a switching element, the fifth display pixel being adapted to display the display color of the second display pixel, the sixth display pixel being adapted to display the display color of the third display pixel, the seventh display pixel being adapted to display the display color of the fourth display pixel, and the eighth display pixel being adapted to display the display color of the first display pixel.

30. The display device set forth in claim 29, wherein:

the first display color is R, the second display color is G, and the third display color is B.

31. The display device as set forth in claim 29, wherein:

the first display color is cyan, the second display color is magenta, and the third display color is yellow.

32. The display device as set forth in claim 29, wherein:

the first display color is R, the second display color is G, the third display color is B, and the fourth display color is white.

33. The display device as set forth in claim 29, wherein:

the first display color is cyan, the second display color is magenta, the third display color is yellow, and the fourth display color is green.

34. The display device as set forth in claim 9, wherein:

the plurality of source lines are provided in parallel with each other; and an image is displayed by a display picture element, which includes display pixels for respectively displaying first, second, and third display colors, the display device comprising first, second, and third display pixel columns, the first display pixel column being a plurality of display pixels connected, respectively through switching elements, to a first source line, which is connected to the first display pixel through a switching element, the first display pixel column being adapted to display one of the first, second, or third display colors, the second display pixel column being a plurality of display pixels connected to a second source line respectively through switching elements, the second source line being connected to the second display pixel through a switching element, the third display pixel column being a plurality of display pixels connected to a third source line respectively through switching elements, the third source line being adjacent to the second source line on a side opposite the first source line, the display pixels of the second display pixel column and the third display pixel column being adapted to form a checkered pattern by displaying two of the first, second, and third display colors that are not the display color of the first display pixel column.

35. The display device as set forth in claim 34, wherein:

the display picture element further includes a display pixel for displaying a fourth display color, the display device further comprising a fourth display pixel column, which is a plurality of display pixels connected to a fourth source line, the fourth source line being adjacent to the third source line on a side opposite the second source line, the display pixels of the second, third, and fourth display pixel columns being adapted to form a checkered pattern by displaying three of the first, second, third, and fourth display colors that are not the display color of the first display pixel column.

36. The display device as set forth in claim 35, wherein:

the first display color is R, the second display color is G, the third display color is B, and the fourth display color is white.

37. The display device as set forth in claim 35, wherein:

the first display color is cyan, the second display color is magenta, the third display color is yellow, and the fourth display color is green.

38. The display device as set forth in claim 34, wherein:

the first display color is R, the second display color is G, and the third display color is B.

39. The display device as set forth in claim 34, wherein:

the first display color is cyan, the second display color is magenta, and the third display color is yellow.

40. A display device, comprising:

display pixels, each of which includes a switching element and a pixel electrode, each of the display pixels being provided at an intersection of one of a plurality of gate lines and one of a plurality of source lines, wherein a first display pixel and a second display pixel are connected to the same gate line, and the second display pixel is connected to a source line that is adjacent to a source line connected to the first display pixel and that forms a parasitic capacitance with the pixel electrode of the first display pixel, and a write signal for the first display pixel is obtained by correcting an input signal for the first display pixel in accordance with an input signal for the second display pixel or a write signal for the second display pixel, and wherein if an effective voltage Va is required in order to display a desired gradation by the first display pixel, a write signal voltage for the first display pixel is a voltage V(A) represented by $$V(A)=(Cp\times Va-Cgd\times Vg-Csdb\times V(B)+Ccs\times Vc)/(Cp+Csda)$$

where V(B) is an input signal voltage or a write signal voltage for the second display pixel, Csda is a capacitance value of a parasitic capacitance formed between the source line connected to the first display pixel and the pixel electrode of the first display pixel, Csdb is a capacitance value of the parasitic capacitance formed between the source line connected to the second display pixel and the pixel electrode of the first display pixel, Cgd is a capacitance value of a parasitic capacitance formed between the gate line connected to the first display pixel and the pixel electrode of the first display pixel, Ccs is a capacitance value of a parasitic capacitance formed between a storage capacitor electrode, which is provided so as to correspond to the first display pixel, and a drain electrode of the switching element of the first display pixel, Vg is a voltage to be applied to the first gate line, Vc is a voltage to be applied to the storage capacitor electrode, and Cp is a capacitance value of the first display pixel.

41. A display device, comprising:

display pixels, each of which includes a switching element and a pixel electrode, each of the display pixels being provided at an intersection of one of a plurality of gate lines and one of a plurality of source lines, wherein a first display pixel and a second display pixel are connected to the same gate line, and the second display pixel is connected to a source line that is adjacent to a source line connected to the first display pixel and that forms a parasitic capacitance with the pixel electrode of the first display pixel, and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values, and wherein if LA is lower than a predetermined threshold value, F(LA, LB) is defined as F(LA, LB)=k(LA−LB), where k>0; and if LA is higher than the threshold value, F(LA, LB) is defined as a function that outputs a constant value.

42. A display device, comprising:

display pixels, each of which includes a switching element and a pixel electrode, each of the display pixels being provided at an intersection of one of a plurality of gate lines and one of a plurality of source lines, wherein a first display pixel and a second display pixel are connected to the same gate line, and the second display pixel is connected to a source line that is adjacent to a source line connected to the first display pixel and that forms a parasitic capacitance with the pixel electrode of the first display pixel, and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values, and wherein a plurality of integers are extracted from within a range of zero to a maximum gradation level, and values of F(LA, 0), where LA is the plurality of integers, are associated with values of LA and stored in a look-up table; and a value of F(LA, LB), where LA is a value not stored in the look-up table, is interpolated in accordance with a value of LA stored in the look-up table, a value of F(LA, 0) associated with the value of LA, and values of LA and LB that satisfy F(LA, LB)=0.

43. A display device, comprising:

display pixels, each of which includes a switching element and a pixel electrode, each of the display pixels being provided at an intersection of one of a plurality of gate lines and one of a plurality of source lines, wherein a first display pixel and a second display pixel are connected to the same gate line, and the second display pixel is connected to a source line that is adjacent to a source line connected to the first display pixel and that forms a parasitic capacitance with the pixel electrode of the first display pixel, and a write signal voltage for the first display pixel is obtained by correcting an input signal voltage for the first display pixel in accordance with an input signal voltage for the second display pixel or a write signal voltage for the second display pixel so that a level Lout of a write signal voltage gradation for the first display pixel satisfies $$Lout=LA+F(LA, LB)$$

where LA is a level of an input signal gradation for the first display pixel, LB is a level of an input signal gradation for the second display pixel, and F(LA, LB) is a function using LA and LB as input values, and wherein if LA<LB, F(LA, LB) is defined as F(LA, LB)=0.

* * * * *